US011456522B2

(12) United States Patent
Huang et al.

(10) Patent No.: US 11,456,522 B2
(45) Date of Patent: Sep. 27, 2022

(54) ANTENNA INTEGRATED DISPLAY SCREEN, DISPLAY APPARATUS AND ELECTRONIC DEVICE

(71) Applicant: YUNGU (GU'AN) TECHNOLOGY CO., LTD., Langfang (CN)

(72) Inventors: Huan-Chu Huang, Taoyuan (CN); Shuang Cui, Langfang (CN); Jie Wu, Langfang (CN)

(73) Assignee: YUNGU (GU'AN) TECHNOLOGY CO., LTD., Hebei (CN)

( * ) Notice: Subject to any disclaimer, the term of this patent is extended or adjusted under 35 U.S.C. 154(b) by 0 days.

(21) Appl. No.: 17/733,459

(22) Filed: Apr. 29, 2022

(65) Prior Publication Data

US 2022/0263220 A1 Aug. 18, 2022

(30) Foreign Application Priority Data

Feb. 15, 2022 (CN) ..... 202210135134.9

(51) Int. Cl.
*H01Q 1/38* (2006.01)
*H01Q 1/22* (2006.01)
*H01Q 21/28* (2006.01)

(52) U.S. Cl.
CPC ..... *H01Q 1/2258* (2013.01); *H01Q 1/38* (2013.01); *H01Q 21/28* (2013.01)

(58) Field of Classification Search
CPC ..... H01Q 1/38; H01Q 21/28; H01Q 1/2258
See application file for complete search history.

(56) References Cited

U.S. PATENT DOCUMENTS

| | | | |
|---|---|---|---|
| 10,747,375 | B2 | 8/2020 | Yoshida et al. |
| 10,892,564 | B1 | 1/2021 | Huang et al. |
| 11,283,172 | B2 | 3/2022 | Huang |
| 2018/0048075 | A1 | 2/2018 | Park et al. |
| 2019/0020114 | A1 | 1/2019 | Paulotto et al. |
| 2020/0251807 | A1 | 8/2020 | Oh et al. |
| 2021/0320395 | A1 | 10/2021 | Wang et al. |
| 2021/0328364 | A1 | 10/2021 | Jia |
| 2021/0344115 | A1 | 11/2021 | Huang et al. |
| 2022/0006180 | A1 | 1/2022 | Oh et al. |

(Continued)

FOREIGN PATENT DOCUMENTS

| | | | |
|---|---|---|---|
| CN | 109728414 | A | 5/2019 |
| CN | 210270841 | U | 4/2020 |

(Continued)

OTHER PUBLICATIONS

Notice of allowance for Taiwan (TW Application No. 111116498) and Search Result with English Translation, dated Jun. 6, 2022, 4 pages.

(Continued)

*Primary Examiner* — Graham P Smith
(74) *Attorney, Agent, or Firm* — Adsero IP

(57) ABSTRACT

The present disclosure relates to an antenna integrated display screen, a display apparatus and an electronic device. The antenna is integrated to the display screen. The antenna includes a millimeter-wave (mm-wave) antenna. The mm-wave antenna includes a plurality of mm-wave antenna elements. At least two of the mm-wave antenna elements are connected to each other to form a connection structure. The connection structure is multiplexed to form at least a first part of a non-mm-wave antenna.

19 Claims, 37 Drawing Sheets

(56) References Cited

U.S. PATENT DOCUMENTS

| | | | |
|---|---|---|---|
| 2022/0029278 | A1 | 1/2022 | Ryu et al. |
| 2022/0029280 | A1 | 1/2022 | Huh et al. |

FOREIGN PATENT DOCUMENTS

| | | | |
|---|---|---|---|
| CN | 111430443 | A | 7/2020 |
| CN | 111614801 | A | 9/2020 |
| CN | 111755813 | A | 10/2020 |
| CN | 111799543 | A | 10/2020 |
| CN | 112306299 | A | 2/2021 |
| CN | 112599962 | A | 4/2021 |
| CN | 112993543 | A | 6/2021 |
| CN | 111541032 | B | 8/2021 |
| CN | 113268154 | A | 8/2021 |
| CN | 113268155 | A | 8/2021 |
| CN | 110534924 | B | 9/2021 |
| CN | 113377245 | A | 9/2021 |
| CN | 113661609 | A | 11/2021 |
| JP | 2014175609 | A | 9/2014 |
| JP | 2016219999 | A | 12/2016 |
| KR | 20180017667 | A | 2/2018 |
| TW | 202143552 | A | 11/2021 |
| TW | 202143557 | A | 11/2021 |
| WO | 2021162380 | A1 | 8/2021 |
| WO | 2021172743 | A1 | 9/2021 |
| WO | 2021217793 | A1 | 11/2021 |

OTHER PUBLICATIONS

Japanese First Office Action (JP Application No. 2022-073956) and Search Result with English Translation, dated Jul. 7, 2022, 2 pages.

Chinese First Office Action 100191 (CN Application No. 202210135134.9) and Search Result with English Translation, dated Mar. 25, 2022, 10 pages.

Chinese Second Office Action 100191 (CN Application No. 202210135134.9) with English Translation, dated Apr. 12, 2022, 5 pages.

Chinese Supplementary Search Result with English Translation, dated Apr. 18, 2022, 3 pages.

PreTrial Opinion Notice (CN Application No. 202210135134.9) and Search Result with English Translation, dated Feb. 9, 2022, 15 pages.

(a)

(b)

B-B'

ANTENNA INTEGRATED DISPLAY SCREEN, DISPLAY APPARATUS AND ELECTRONIC DEVICE

CROSS REFERENCE TO RELATED APPLICATIONS

This application claims priority to Chinese Patent Application No. 2022101351349, entitled "ANTENNA INTEGRATED DISPLAY SCREEN, DISPLAY APPARATUS AND ELECTRONIC DEVICE" filed on Feb. 15, 2022, the contents of which is incorporated by reference in its entirety.

TECHNICAL FIELD

The present application relates to the field of antenna integrated display screen.

BACKGROUND

With the development of display technologies and communication technologies, a screen-to-body ratio of a display apparatus in an electronic device with a wireless communication function tends to be higher and higher, and the types and numbers of antennas in an electronic device are also increasing. For example, in the era of the $5^{th}$ generation mobile communications (5G), the spectrum of wireless communications cover millimeter-wave (mm-wave) bands and non-mm-wave bands. Moreover, in the era of 5G, the 4G (non-mm-wave) spectrum still continues. Therefore, electronic devices with a 5G mm-wave function, such as mobile phones, are generally provided with type-II antennas with operating frequency bands that can cover non-mm-wave bands (such as 5G or 4G) in addition to type-I antennas with operating frequency bands that can cover mm-wave bands.

SUMMARY

Embodiments of the present disclosure provide an antenna integrated display screen, a display apparatus and an electronic device, so as to integrate antennas to the display screen of the display apparatus in the electronic device and enable operating frequency bands of the antennas to cover mm-wave bands and non-mm-wave bands at the same time. The present invention discloses an antenna integrated display screen, which may effectively reduce a dimension of the antenna(s) (i.e., smaller than a sum of dimensions when the above two types of AoDs are separately arranged), and reduce the influences of the antennas on the visual optical effect and the touch effect of the display screen, so as to increase functions and value of the display screen and ensure visual and tactile experience of users.

According to one aspect of the present invention, an antenna integrated display screen is provided. The antenna integrated to the display screen includes a mm-wave antenna. The mm-wave antenna includes a plurality of mm-wave antenna elements. At least two of the mm-wave antenna elements are connected to each other to form a connection structure. The connection structure is multiplexed to form at least a first part of a non-mm-wave antenna.

In the present invention, the connection structure formed by at least two mm-wave antenna elements by connection is multiplexed to form at least a first part of the non-mm-wave antenna. That is, the connection structure has a function equivalent to the non-mm-wave antenna(s), so that the mm-wave antenna or a part thereof can also have a function equivalent to the non-mm-wave antenna(s). In this way, it is beneficial to reduce the number of regions to be cut for forming antennas in a conductive mesh layer and to reduce the differences between the different cut patterns and uncut regions in the conductive mesh layer, to ensure the visual optical effect and the touch effect of the display screen.

In some embodiments, the non-mm-wave antenna further includes at least one first connecting line. At least two of the mm-wave antenna elements in the connection structure are connected to each other through at least one first connecting line. The first connecting line is configured to block transmission of mm-wave energy between any two mm-wave antenna elements.

Optionally, a line width of the first connecting line is less than or equal to a line width of the first wire or the second wire. The line width of the first connecting line refers to a dimension of an orthographic projection of the first connecting line in a plane parallel to a display panel in a direction perpendicular to an extension direction of the first connecting line. In this way, the line width of the first connecting line being equal to the line width of the first wire or the second wire may ensure maturity, simplicity and low costs of an antenna manufacturing process.

Optionally, at least two of the mm-wave antenna elements in the connection structure are connected to each other through a plurality of first connecting lines, a sum of line widths of the plurality of first connecting lines is a first dimension, a side length of a side of any of the mm-wave antenna elements correspondingly connected to the plurality of first connecting lines are a second size, and the first dimension is less than or equal to one fourth of the second size.

In the present application, the first connecting line with a smaller line width can well filter and block the energy in mm-wave bands, but filter and block less energy in non-mm-wave bands. Therefore, in the connection structure, two mm-wave antenna elements are connected by the first connecting line with a function of well filtering and blocking the mm-wave bands, which may ensure the antenna performance of the mm-wave antenna elements in their respective operating frequency bands, so as to reduce a degree of the influence of their connection on the antenna performance. Moreover, the first connecting line between the two mm-wave antenna elements may not filter and block the energy in the non-mm-wave bands. Therefore, the connection structure formed by a plurality of mm-wave antenna elements by connection being multiplexed as a non-mm-wave antenna or a first part of a non-mm-wave antenna may not affect the antenna performance of the non-mm-wave antenna.

For example, the second part further includes a first section, a final section and a middle section connected between the first section and the final section; and the first section is configured to be connected to a non-mm-wave radio frequency integrated circuit (non-mm-wave RFIC).

Optionally, the first section and the final section of the second part of the non-mm-wave antenna are located on two sides of the mm-wave antenna respectively, and the final section is connected to the mm-wave antenna element closest to the final section in the connection structure. In this way, the second part of the non-mm-wave antenna may be connected in series with a series structure of the plurality of mm-wave antenna elements in the connection structure, and the non-mm-wave antenna using this structure is ensured to have a longer length and a larger area in a limited space range, so as to reasonably control the operating frequency and bandwidth of the non-mm-wave antenna.

In another possible implementation, the mm-wave antenna elements in the connection structure are separately arranged and connected to the second part through the second connecting line respectively. The second connecting line is configured to block transmission of mm-wave energy between the mm-wave antenna element and the second part of the non-mm-wave antenna.

In the present application, on the basis of multiplexing the connection structure to form the first part of the non-mm-wave antenna, the operating frequency and bandwidth of the non-mm-wave antenna can be reasonably controlled with the arrangement of the second part of the non-mm-wave antenna and the relative position relationship and the connection relationship between the second part and the first part. Moreover, in some examples where the second part and the first part of the non-mm-wave antenna are connected in parallel, the non-mm-wave antenna may have a plurality of different resonant paths to have a plurality of different operating frequency bands, so as to realize multi-frequency-range communications of the non-mm-wave antenna.

In the present application, the non-mm-wave antenna includes a first part and a second part connected to each other, and the first part of the non-mm-wave antenna is formed by mm-wave antenna elements by multiplexing, so dimensions of other portions in the non-mm-wave antenna other than the mm-wave antenna elements in the first part, for example, a length of the second part of the non-mm-wave antenna, may be reduced. That is, at a same operating frequency, the more the mm-wave antenna elements that constitute the first part are multiplexed in the non-mm-wave antenna, the shorter the length of other components in the non-mm-wave antenna except the first part may be. Thus, a cutting length of the conductive mesh configured to form the second part of the non-mm-wave antenna in the conductive mesh layer may be reduced, so as to further ensure the visual optical effect and the touch effect of the display apparatus.

In some embodiments, the antenna further includes a grounding portion.

Optionally, the grounding portion is located on one side of the second part of the non-mm-wave antenna away from the mm-wave antenna and connected to the second part of the non-mm-wave antenna.

Optionally, the grounding portion is located on one side of the mm-wave antenna away from the second part of the non-mm-wave antenna, and connected to any one of the mm-wave antenna elements in the connection structure through the second connecting line.

Optionally, the grounding portion is located between the mm-wave antenna and the second part of the non-mm-wave antenna, and connected to any one of the mm-wave antenna elements in the connection structure through the second connecting line.

Optionally, at least two non-mm-wave antennas are provided. The grounding portion is located between two adjacent non-mm-wave antennas.

In the present invention, with the arrangement of the grounding portion at different positions of the antenna, the operating frequency and bandwidth of the non-mm-wave antenna can be controlled reasonably by using the relative position relationship and the connection relationship among the grounding portion, the non-mm-wave antenna and the mm-wave antenna. For example, the non-mm-wave antenna is connected in series with the grounding portion, so that the non-mm-wave antenna may have a longer length, so as to cover lower antenna operating frequencies.

In some embodiments, the first part of the non-mm-wave antenna further includes an extension portion. The extension portion is located on one side of the mm-wave antenna away from the second part of the non-mm-wave antenna, or the extension portion is located between the second part of the non-mm-wave antenna and the mm-wave antenna.

Optionally, one end of the extension portion is connected to any one of the mm-wave antenna elements in the connection structure, and the other end of the extension portion is suspended.

Optionally, the extension portion is formed by at least one first connecting line with one end suspended.

In the present invention, the first part of the non-mm-wave antenna is provided with the extension portion, so that a length of the first part of the non-mm-wave antenna may be adjusted by setting a length of the extension portion, so as to control the operating frequency of the first part of the non-mm-wave antenna.

In some embodiments, the antenna includes at least two non-mm-wave antennas. The second parts in different non-mm-wave antennas have different structures. In this way, different mm-wave antenna elements in a same mm-wave antenna can be multiplexed to form first parts of two or more non-mm-wave antennas. Moreover, the second parts of the non-mm-wave antennas may be controlled to have different operating frequencies and bandwidths by providing the second parts of the non-mm-wave antennas with different contour shapes and extension lengths. That is, the antenna may have at least two different types of non-mm-wave antennas at the same time.

In some embodiments, the antenna includes at least two non-mm-wave antennas. The antenna further includes: an isolation portion located between any two adjacent non-mm-wave antennas. In this way, adjacent non-mm-wave antennas can be effectively isolated by using the isolation portion, so as to prevent mutual interference between the adjacent non-mm-wave antennas. Thus, each non-mm-wave antenna is ensured to have better antenna performance.

According to another aspect of the present invention, a display apparatus is provided. The display apparatus includes: the antenna integrated display screen as described in some embodiments above.

Optionally, the display apparatus further includes a Flexible Printed Circuit (FPC) and a mm-wave RFIC and a connecting base that are arranged on the FPC. The mm-wave RFIC is connected to the mm-wave antenna elements and the connecting base through the FPC. The connecting base is connected to the non-mm-wave antenna(s) through the FPC and configured to be connected to a non-mm-wave RFIC.

In the present invention, the mm-wave antenna elements may be connected to the mm-wave RFIC through the FPC. The mm-wave RFIC may be connected to the connecting base through the FPC and then connected to a Printed Circuit Board (PCB) of the display apparatus through the connecting base. The non-mm-wave RFIC may be arranged on the PCB. The non-mm-wave antenna(s) may be connected to the connecting base through the FPC and then connected to the non-mm-wave RFIC through the connecting base.

Optionally, the display apparatus further includes an FPC and a mm-wave RFIC and a non-mm-wave RFIC that are arranged on the FPC; wherein the mm-wave RFIC is connected to the mm-wave antenna element through the FPC; and the non-mm-wave RFIC is connected to the non-mm-wave antenna through the FPC.

In the present invention, the mm-wave RFIC and the non-mm-wave RFIC may be both integrated onto the FPC. In this way, the mm-wave antenna elements may be connected to the mm-wave RFIC through the FPC. The non-mm-wave antenna(s) may be connected to the non-mm-wave RFIC through the FPC.

The mm-wave antenna(s) and the non-mm-wave antenna(s) in the antenna(s) can have independent communication links, and the mm-wave antenna(s) and the non-mm-wave antenna(s) can work at the same time without affecting each other. Moreover, in the present application, the mm-wave antenna(s) and the non-mm-wave antenna(s) may share a same FPC to reduce a total number of FPCs in the display apparatus and reduce assembly complexity of the display apparatus, thereby helping improve the manufacturing efficiency of the display apparatus and reducing manufacturing costs of the display apparatus.

According to yet another aspect of the present invention, an electronic device is provided. The electronic device includes the display apparatus as described in some embodiments above.

Optionally, the electronic device further includes a non-mm-wave tunable component configured to tune the non-mm-wave antenna. The non-mm-wave tunable component is arranged on the FPC. Alternatively, the electronic device further includes a PCB connected to the FPC; and the non-mm-wave tunable component is arranged on the PCB. In this way, the non-mm-wave antenna may be tuned by using the non-mm-wave tunable component, to reconstruct the antenna performance of the non-mm-wave antenna. Details of one or more embodiments of the present application are set forth in the following figures and description. Other features, objects and advantages of the present application will become apparent from the description, the figures and the claims.

BRIEF DESCRIPTION OF THE DRAWINGS

By reading detailed descriptions of the following preferred implementations, those of ordinary skill in the art may clearly understand various other advantages and benefits. The accompanying drawings are merely intended to show objectives of the preferred implementations, but are not considered as a limitation on the present disclosure. In addition, the same reference numeral is used to indicate the same member throughout the accompanying drawings. In the accompanying drawings.

DETAILED DESCRIPTION OF THE EMBODIMENTS

Figure 1:
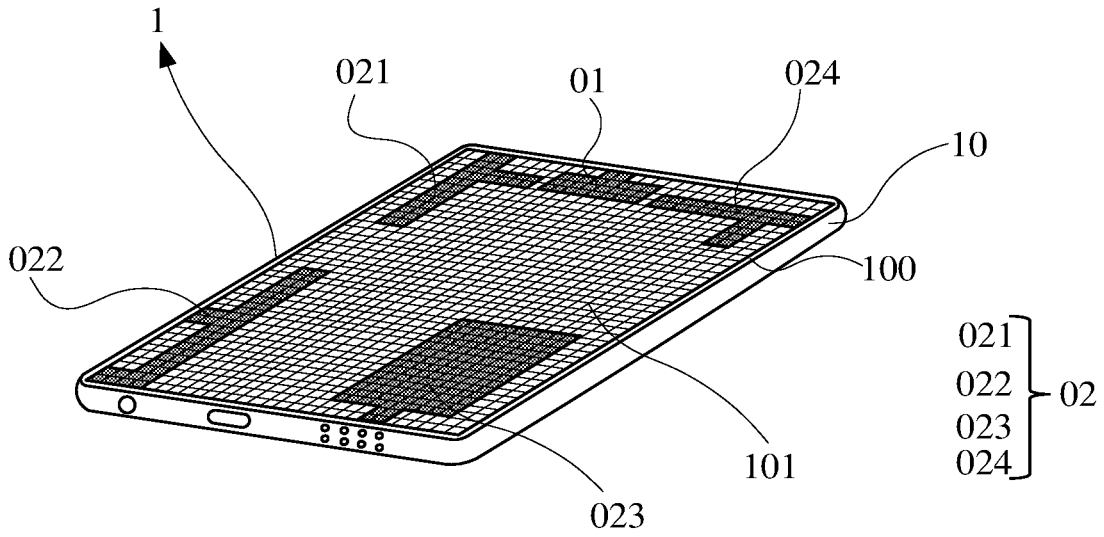
FIG. 1 is a schematic structural diagram of an electronic device 1.

To facilitate understanding of the present disclosure, a more comprehensive description of the present disclosure will be given below with reference to the relevant accompanying drawings. Preferred embodiments of the present disclosure are given in the drawings. However, the present disclosure may be implemented in many different forms and is not limited to the embodiments described herein. Rather, these embodiments are provided to make the contents disclosed in the present disclosure more fully understood.

It is to be understood that, although the terms "first", "second", etc., may be used herein to describe elements, they do not indicate any order, quantity, or importance, but are intended only to distinguish different components. "Comprise" or "include" and other similar words mean that an element or item appearing before the word covers elements or items appearing after the word and equivalents thereof, without excluding other elements or items.

Unless defined otherwise, all technical and scientific terms used herein have the same meanings as would generally understood by those skilled in the technical field of the present disclosure. The terms used herein in the specification of the present disclosure are for the purpose of describing specific embodiments only, and are not intended to limit the present disclosure.

The term "connect" used herein may refer to a manner of an electrical connection that enables signal transmission. The term "connect" should be understood in a broad sense, such as a direct electrical connection or an indirect electrical connection through an intermediate medium, for example, the coupling way.

"Embodiment" mentioned herein means that a particular feature, structure, material, or characteristic described in connection with the embodiment is included in at least one embodiment of the present disclosure. The phrase appearing at various positions in the specification does not necessarily refer to the same embodiments, nor to separate or alternative embodiments that are mutually exclusive with other embodiments. It is understood explicitly and implicitly by those skilled in the art that the embodiments described herein may be combined with other embodiments.

In the description of the present application, the orientation or position relationship indicated by the technical terms "upper", "lower", "left", "right", etc. are based on the orientation or position relationship shown in the accompanying drawings and are intended to facilitate the description of the present application and simplify the description only, rather than indicating or implying that the apparatus or element referred to must have a particular orientation or be constructed and operated in a particular orientation, and therefore are not to be interpreted as limiting the present application.

In order to clearly represent multiple layers and regions in the drawings, the thickness of each layer and each region in the drawings are enlarged to clearly indicate the relative position between layers and the distribution of each region. When a part expressed as a layer, film, region, plate, etc. is "above" or "on" another part, the expression includes not only the situation where it is "directly" above the another part, but also the situation where other layers exist there between.

The higher the screen-to-body ratio of the display apparatus in the electronic device, the easier it is to limit the placement locations of the antennas. Moreover, the antennas are generally more easily blocked in use (for example, when it is held or placed on a metal table), which results in significant deterioration of the performance of the antenna and affects wireless experience of users. In view of the above, a design manner of integrating antennas to the display apparatus of the electronic device, such as Antenna-on-Display (AoD), has become a possible development trend of antenna design in the electronic device.

With the development of display technologies and communications technologies, a screen-to-body ratio of a display apparatus in an electronic device tends to be higher and higher, and types and number of antennas in the electronic device are also increasing. For example, in the era of the $5^{th}$ generation mobile communications, the spectrum of wireless communications cover mm-wave bands and non-mm-wave bands. Moreover, in the era of 5G, the 4G (non-mm-wave) spectrum still continues. Therefore, electronic devices with a 5G mm-wave function, such as mobile phones, are generally provided with type-II antennas with operating frequency bands that can cover non-mm-wave bands (such as 5G or 4G) in addition to type-I antennas with operating frequency bands that can cover mm-wave bands.

The higher the screen-to-body ratio of the display apparatus in the electronic device, the easier it is to limit the placement locations of the antennas. Moreover, the antennas are generally more easily blocked in use (for example, when it is held in hand or it is placed on a metal table), which results in significant deterioration of the performance of the antenna and affects wireless experience of users. In view of the above, a design manner of integrating antennas to the display apparatus of the electronic device, such as AoD, has become a possible development trend of antenna design in the electronic device.

In some embodiments, referring to FIG. 1, an electronic device 1 is a mobile phone, and at least two types of antennas are integrated to a display apparatus 10 of the mobile phone, including type-I antenna 01 and type-II antenna 02 for example. The operating frequency bands of the type-I antenna 01 may cover mm-wave bands, and the operating frequency bands of the type-II antenna 02 may cover non-mm-wave bands (such as 5G and 4G). The type-I antenna 01 and the type-II antenna 02 may be integrated to a display screen 100 of the display apparatus 10. The type-I antenna (i.e., mm-wave antenna) 01 is, for example, a 5G mm-wave antenna. The type-II antenna (i.e., non-mm-wave antenna) 02 includes, for example, at least one of a WiFi/BT antenna 021, an LTE antenna 022, a Near Field Communication (NFC) antenna 023 and a 5G non-mm-wave antenna 024. The type-I antenna 01 and the type-II antenna 02 can be integrated to the display screen 100, or can be outwardly assembled to the display screen 100.

For example, as shown in FIG. 1, the type-I antenna 01 (5G mm-wave antenna), the WiFi/BT antenna 021, the LTE antenna 022, the NFC antenna 023 and the 5G non-mm-wave antenna 024 may be separately integrated to the display screen 100 of the display apparatus 10 respectively.

When the antennas are integrated to the display screen 100 of the display apparatus 10, as one implementation, a conductive mesh layer 101 may be provided in the display screen 100, and then the antennas are manufactured by cutting conductive meshes in the conductive mesh layer 101. That is, an antenna mesh is disconnected from (namely, non-directly-electrically connected to) a non-antenna mesh. In this way, in the case of many types and numbers of antennas, conductive meshes in a plurality of different regions are generally required to be cut to form corresponding antennas. Moreover, the conductive mesh layer 101 includes a part located in a display region of the display screen 100, and further includes a part located in a non-display region. Therefore, if there are an excessive number of cutting regions in the conductive meshes or many conductive meshes in the plurality of different regions are cut, mesh patterns in the conductive mesh layer 101 have significant differences or many touch dead zones. Thus, it is easy to cause deterioration of a visual optical effect and a touch effect of the display screen 100 in the display apparatus 10.

According to some embodiments of the present disclosure, an antenna 2 that can be integrated to the display screen 100 or outwardly assemble to the display screen 100 is provided, which enables operating frequency bands of the antenna 2 to cover mm-wave bands and non-mm-wave bands at the same time and effectively ensures the visual optical effect and the touch effect of the display screen 100.

Figure 2:
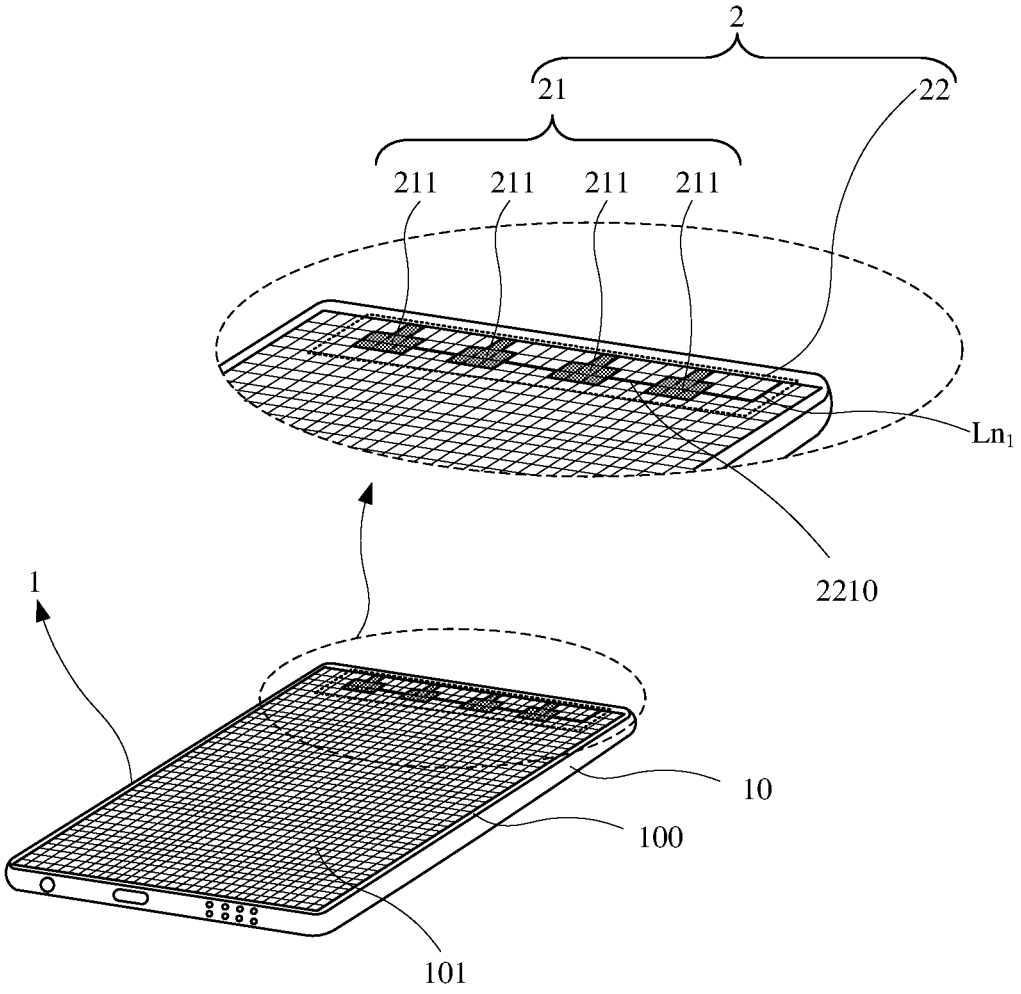
FIG. 2 is a schematic structural diagram of another electronic device 1.
Figure 3:
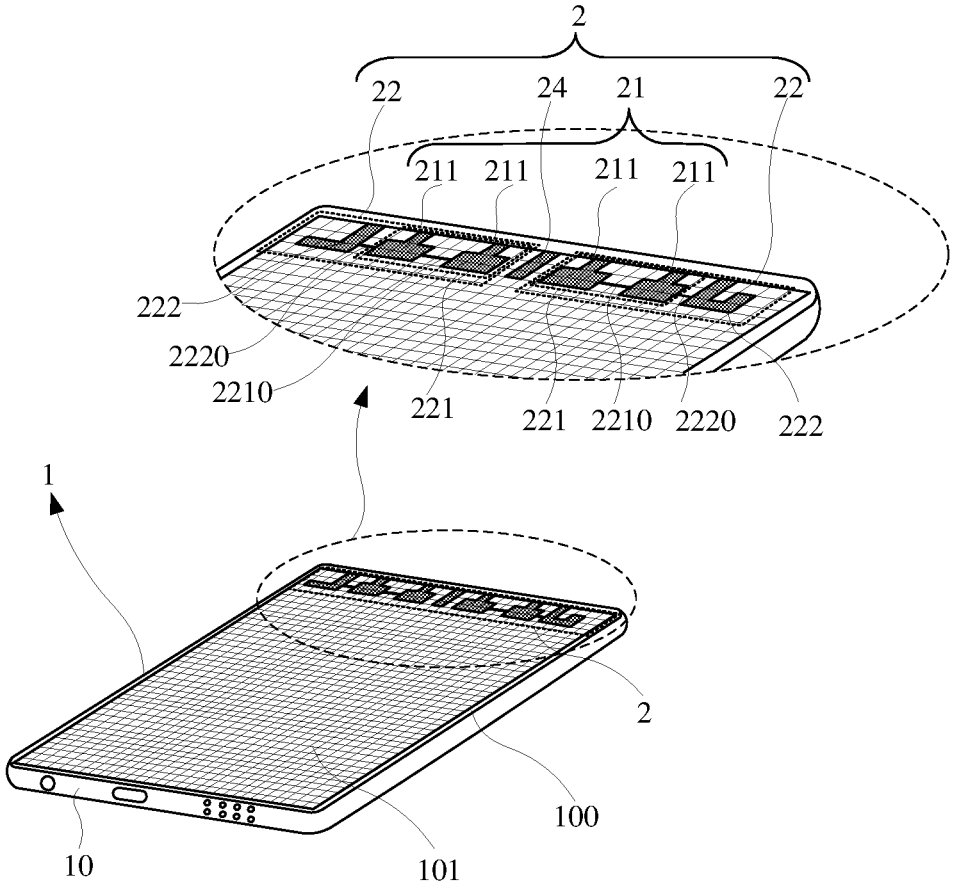
FIG. 3 is a schematic structural diagram of yet another electronic device 1.

Referring to FIG. 2 and FIG. 3, the display screen 100 includes a conductive mesh layer 101, and the antenna 2 is formed by at least part of a pattern of the conductive mesh layer 101. The antenna 2 includes a mm-wave antenna 21. The mm-wave antenna 21 includes a plurality of mm-wave antenna elements 211. At least two mm-wave antenna elements 211 are connected (electrically connected, or coupled) to each other to form a connection structure. The connection structure is multiplexed to form at least a first part of a non-mm-wave antenna 22. In this application, the connecting relationship means electrically connecting or coupling.

Herein, the connection structure is multiplexed to form at least a first part of a non-mm-wave antenna 22 and includes: the connection structure multiplexed to form the first part 221 of the non-mm-wave antenna 22, or the connection structure multiplexed to form the non-mm-wave antenna 22.

In some embodiments, referring to FIG. 2, the antenna 2 includes a mm-wave antenna 21. The mm-wave antenna 21 includes a plurality of mm-wave antenna elements 211. At least two mm-wave antenna elements 211 are connected to each other to form a connection structure. The connection structure is multiplexed to form a non-mm-wave antenna 22.

Herein, the connection structure formed by connecting at least two mm-wave antenna elements 211 may have a function equivalent to a non-mm-wave antenna(s) 22, so as to serve as the non-mm-wave antenna 22. That is, the mm-wave antenna 21 or a part of the mm-wave antenna 21 is also enabled to have a function equivalent to a non-mm-wave antenna(s) 22. Moreover, when the connection structure is used as the non-mm-wave antenna 22, the connection structure may be led out by connecting a non-mm-wave feeding portion (such as a non-mm-wave 22 signal line $Ln_1$), so that the connection structure can be connected to a non-mm-wave RFIC 500 through the non-mm-wave feeding portion, so as to realize the function of the non-mm-wave antenna 22.

Optionally, still referring to FIG. 2, the non-mm-wave antenna 22 includes a first connecting line 2210. In the connection structure multiplexed as the non-mm-wave antenna 22, at least two mm-wave antenna elements 211 are connected to each other through at least one first connecting line 2210. For example, as illustrated in FIG. 2, any two adjacent mm-wave antenna elements 211 are connected through the first connecting line 2210, and any mm-wave antenna element 221 may also be connected to the non-mm-wave RFIC 500 through the first connecting line 2210, so that the first connecting line 2210 is directly used as the non-mm-wave feed-ing portion of the non-mm-wave antenna 22.

In some other embodiments, referring to FIG. 3, the antenna 2 includes a mm-wave antenna 21 and a non-mm-wave antenna 22. The mm-wave antenna 21 includes a plurality of mm-wave antenna elements 211. The non-mm-wave antenna 22 includes a first part 221 and a second part 222. At least two mm-wave antenna elements 211 are connected to each other to form a connection structure. The connection structure is multiplexed to form the first part 221 of the non-mm-wave antenna 22.

Herein, the first part 221 of the non-mm-wave antenna 22 includes a connection structure formed by connecting at least two mm-wave antenna elements 211. The mm-wave antenna elements 211 in the connection structure can be multiplexed as a radiation portion of the first part 221 of the non-mm-wave antenna 22. That is, the connection structure can equivalently realize a radiation function of the first part 221 of the non-mm-wave antenna 22.

It may be understood that the mm-wave antenna elements 211 in the connection structure in some embodiments above may be sequentially connected or connected according to a predetermined rule.

In addition, optionally, the non-mm-wave antenna 22 may serve as a WiFi/BT antenna 021, an LTE antenna 022, an NFC antenna 023, a 5G non-mm-wave antenna 024, a Global Positioning System (GPS) antenna or the like.

Optionally, the mm-wave antenna elements 211 include single-polarization mm-wave antenna elements or dual-polarization mm-wave antenna elements.

It is to be noted that, compared with non-mm-wave band signals, mm-wave band signals have wider bandwidth, higher channel capacity, and finer imaging granularity, thus enabling faster data transmission and more detailed image resolution, so as to meet users' requirements for high information rates and clear images. However, the mm-wave band signals have higher propagation losses than the non-mm-wave band signals. Therefore, in the embodiment of the present disclosure, the plurality of mm-wave antenna elements 211 are arranged adjacent to each other or arranged in an array to form the mm-wave antenna 21, to improve antenna gains to compensate for higher path losses, and may achieve an effect of beam scanning to cover a wider space to reduce wireless communication dead zones, thereby attaining better user wireless experience.

In addition, the connections between the plurality of mm-wave antenna elements 211 in the connection structure may be series connections or parallel connections. Moreover, the connection between any two adjacent mm-wave antenna elements 211 in the connection structure may be realized by using a conductive structure with a mm-wave-band energy blocking function. The conductive structure is, for example, a connecting line capable of conducting electricity. In this way, each mm-wave antenna element 211 in the connection structure may work in its own mm-wave operating frequency band, without being adversely affected by connections between adjacent mm-wave antenna elements 211. Moreover, the conductive structure used in the connection between any two adjacent mm-wave antenna elements 211 in the connection structure may well transmit energy in non-mm-wave bands, so as to ensure that the non-mm-wave antenna 22 or the first part 221 of the non-mm-wave antenna 22 formed by the connection structure by multiplexing has a good function of non-mm-wave antenna.

It is to be noted that the antenna 2 integrated to the display screen 100 may be obtained by cutting at least part of a conductive mesh in the conductive mesh layer 101 of the display screen 100. Exemplarily, the mm-wave antenna element 211 includes: a conductive mesh formed by a plurality of first wires extending along a first direction and a plurality of second wires extending along a second direction by crossing. It should be understood that "crossing" may refer to a crossing relationship in projection, e.g., the first wire and the second wire may be located in different planes.

Optionally, referring to FIG. 4 to FIG. 8, the mm-wave antenna element 211 includes: a conductive mesh formed by a plurality of first wires L1 and a plurality of second wires L2 by staggered connection. The first wires L1 extend along a first direction, and the second wires L2 extend along a second direction. The first direction intersects with the second direction. For example, in some implementations, the first direction and the second direction are perpendicular to each other.

Figure 4:
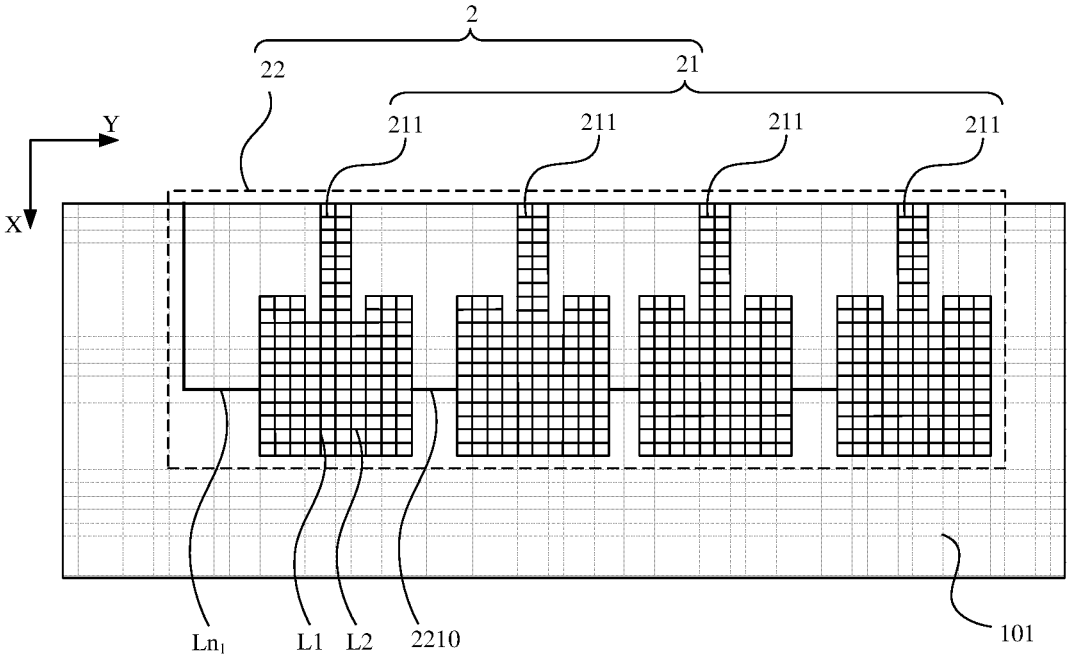
FIG. 4 is a schematic structural diagram of an antenna 2.
Figure 5:
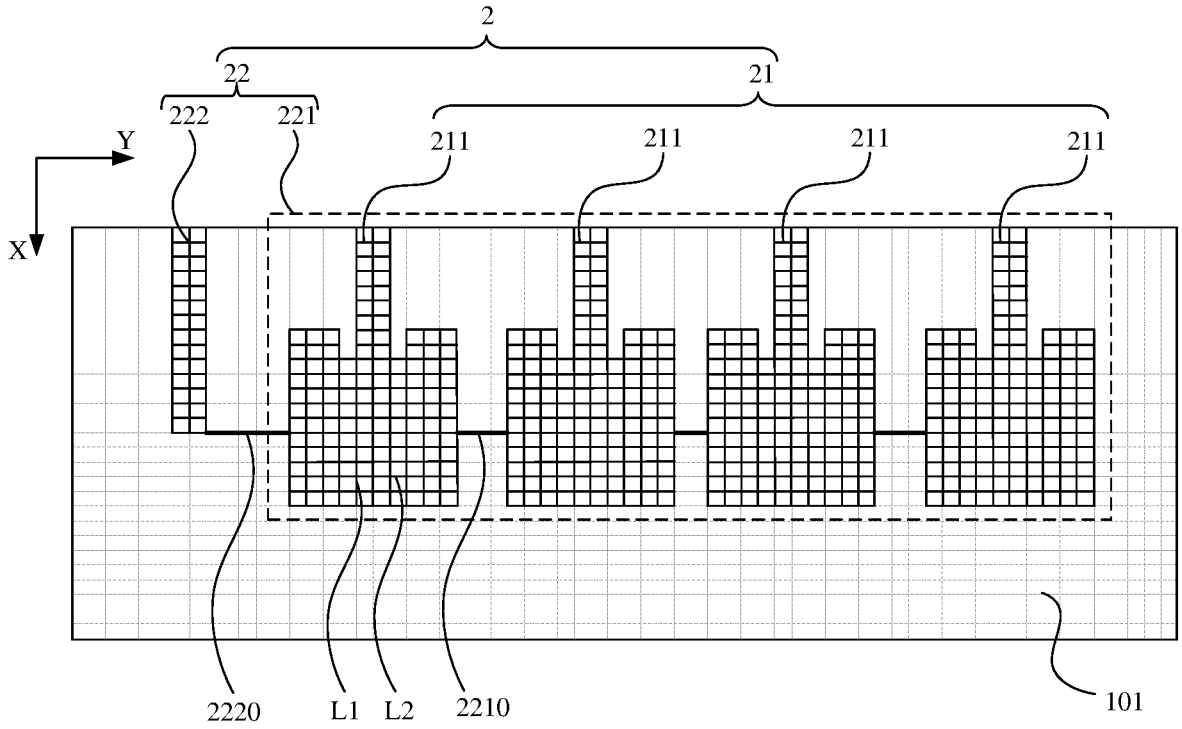
FIG. 5 is a schematic structural diagram of another antenna 2.
Figure 6:
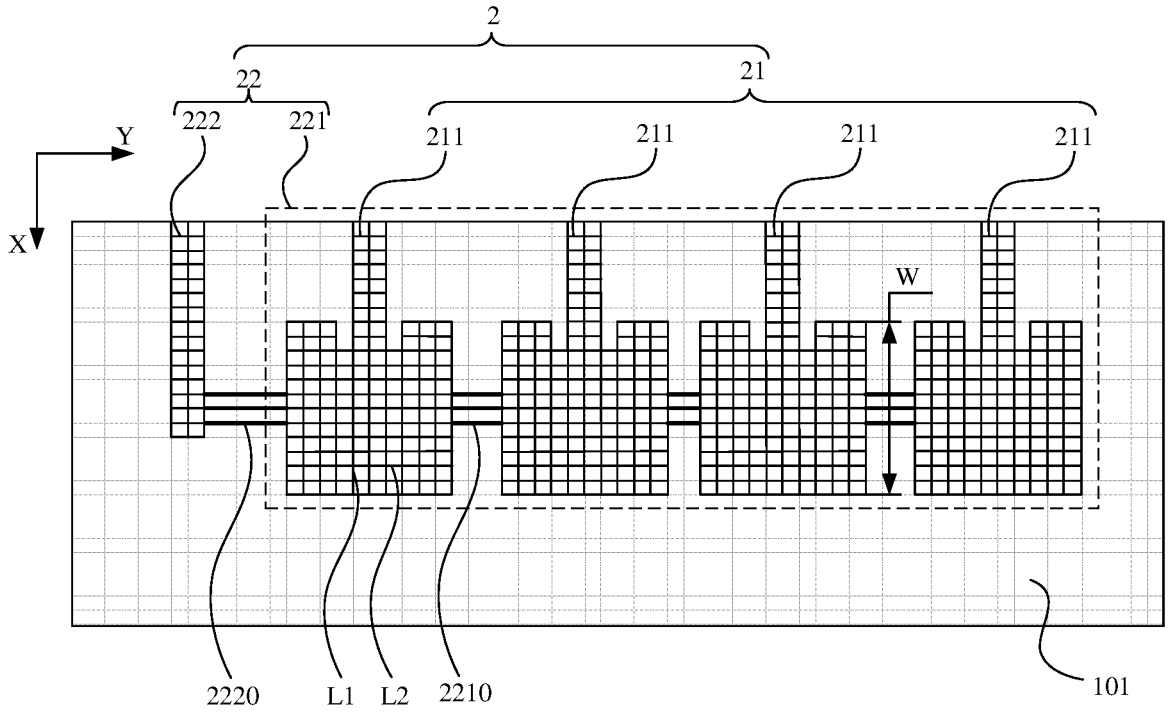
FIG. 6 is a schematic structural diagram of yet another antenna 2.
Figure 7:
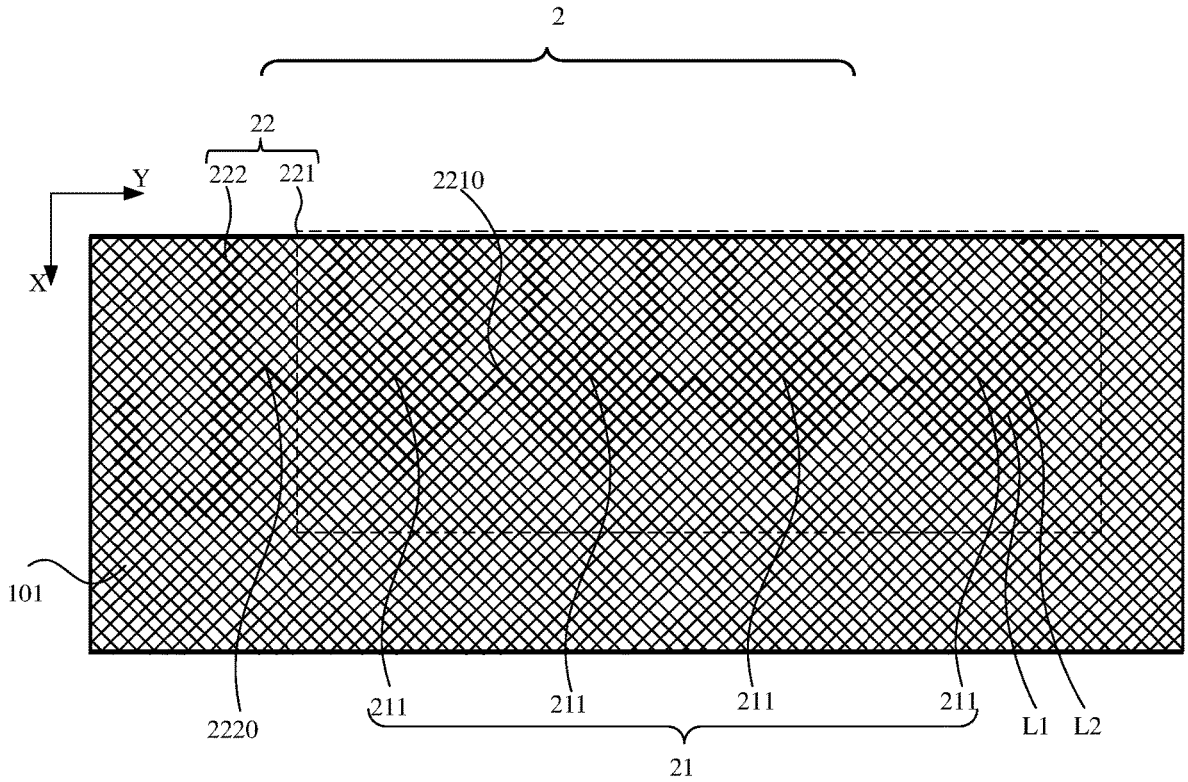
FIG. 7 is a schematic structural diagram of still another antenna 2.
Figure 8:
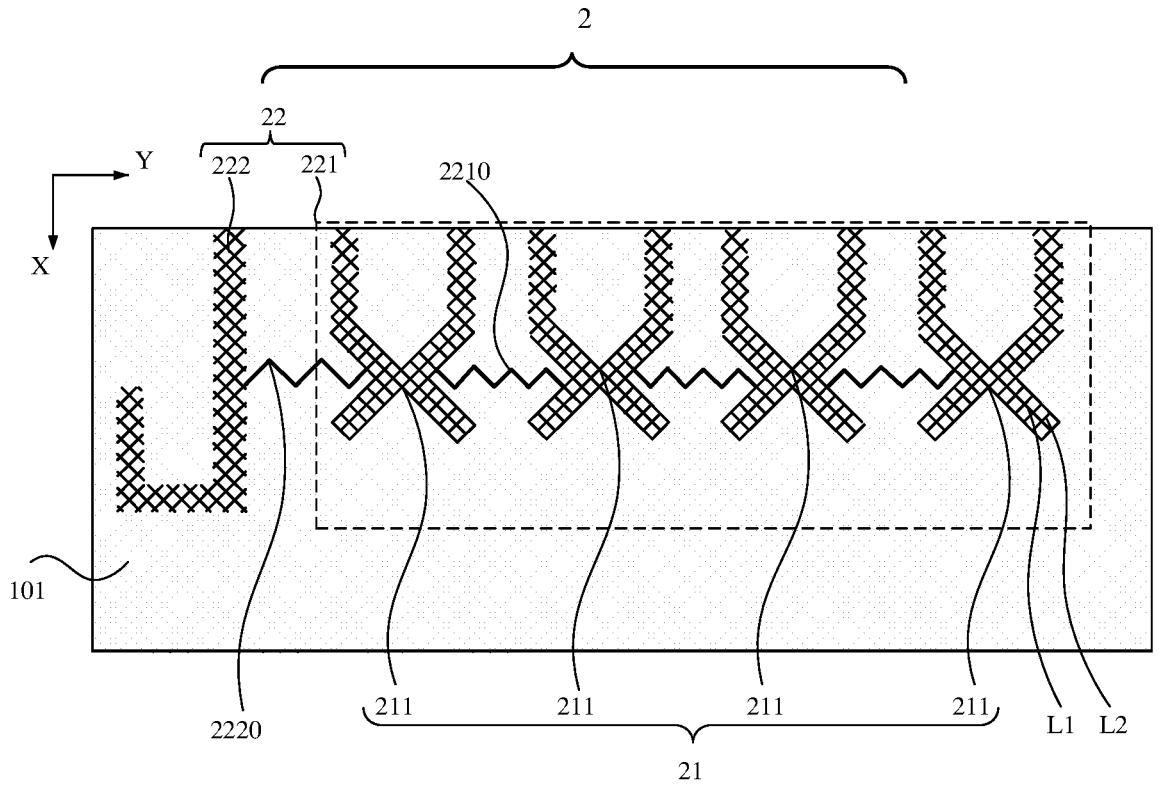
FIG. 8 is a schematic structural diagram of a further antenna 2.

Optionally, as shown in FIG. 4, FIG. 5 and FIG. 6, the first direction is a vertical direction, for example, X direction; and the second direction is a horizontal direction, for example, Y direction. However, they are not limited thereto. For example, referring to FIG. 7 and FIG. 8, the first direction may be at a first angle with respect to the vertical direction. The first angle is, for example, 30°, 45°, or 60°. For example, the second direction may be at a second angle with respect to the horizontal direction. The second angle is, for example, the same as the first angle.

Correspondingly, the conductive mesh layer 101 in the display screen 100 may be formed by a plurality of parallel lines of the first wires L1 (including the first wires L1) and a plurality of parallel lines of the second wires L2 (including the second wires L2) by staggered connection. In this way, the mm-wave antenna elements 211 may be directly obtained by cutting corresponding conductive meshes in the conductive mesh layer 101.

In some embodiments above, the connections between the plurality of mm-wave antenna elements 211 in the connection structure multiplexed to form the non-mm-wave antenna 22 or the first part 221 of the non-mm-wave antenna 22 and the connection between the first part 221 and the second part 222 of the non-mm-wave antenna 22 may be implemented in many different manners.

In one possible implementation, the electrical connections between the plurality of mm-wave antenna elements 211 in the connection structure may be series connections.

Optionally, still referring to FIG. 4 to FIG. 8, the non-mm-wave antenna 22 further includes a first connecting line 2210. In the connection structure multiplexed to form the non-mm-wave antenna 22 or the first part 221 of the non-mm-wave antenna 22, at least two mm-wave antenna elements 211 are connected to each other through at least one first connecting line 2210. For example, any two adjacent mm-wave antenna elements 211 are connected through at least one first connecting line 2210 (directly electrically connected). The first connecting line 2210 is configured to block transmission of mm-wave energy between the any two adjacent mm-wave antenna elements 211. In this application, the connecting relationship means electrically connecting or coupling.

Herein, the number, the line length, and the line width of the first connecting line 2210 may be selectively set according to actual requirements, which are not limited in the embodiment of the present disclosure. The line length of the first connecting line 2210 refers to a dimension in an extension direction of the first connecting line 2210. The line width of the first connecting line 2210 refers to a dimension in a direction perpendicular to the extension direction of the first connecting line 2210.

In addition, optionally, the first connecting line 2210 may be formed by parallel lines of the first wires L1 and/or parallel lines of the second wires L2 in the conductive mesh layer 101. For example, the first connecting line 2210 may be constructed as a straight line, and the first connecting line 2210 may be formed by parallel lines of the first wires L1 or parallel lines of the second wires L2 in the conductive mesh layer 101. For example, the first connecting line 2210 may be constructed as a broken line, and the first connecting line 2210 may be formed by parallel lines of the first wires L1 and parallel lines of the second wires L2 connected thereto in the conductive mesh layer 101. In this way, the line width of the first connecting line 2210 may be equal to the line width of the first wire L1 or the second wire L2, so as to ensure maturity, simplicity and low costs of a manufacturing process of the antenna 2.

It is to be noted that the shape into which the first connecting line 2210 is constructed is not limited to the straight line or broken line, and may also be other shapes. For example, the first connecting line 2210 is constructed as an arc or the like. Moreover, the line width of the first connecting line 2210 is not limited to being equal to the line width of the first wire L1 or the second wire L2. For example, the line width of the first connecting line 2210 may also be less than the line width of the first wire L1 or the second wire L2, which is not limited in the embodiment of the present disclosure.

Since the frequencies of the mm-wave bands are significantly higher than those of the non-mm-wave bands for and before 5G (such as 4G), the skin depths of the mm-wave bands are obviously thinner than those of the foregoing non-mm-wave bands. Therefore, as to a same connecting line (if its thickness is greater than the skin depths of the mm-wave bands), the resistance and inductance values of the mm-wave bands generally may be higher than those of the non-mm-wave bands. Moreover, as to the connecting lines 2210 of a same line length (when the thickness of the connecting line is greater than the skin depths of the mm-wave bands), the smaller the line width of the first connecting line 2210 is, the higher the inductance of the first connecting line 2210 is. Therefore, impedance of the first connecting line 2210 with a smaller line width for the mm-wave bands is significantly higher than that for the non-mm-wave bands for and before 5G. That is, the first connecting line 2210 with a smaller line width can well filter and block the energy in mm-wave bands, but filter and block less energy in the non-mm-wave bands for and before 5G. In this way, in the embodiment of the present disclosure, in at least two mm-wave antenna elements 211 multiplexed to form the non-mm-wave antenna 22 or the first part 221 of the non-mm-wave antenna 22, two adjacent mm-wave antenna elements 211 are connected by the first connecting line 2210 with a function of well filtering and blocking the energy in mm-wave bands, which may ensure the antenna performance of adjacent mm-wave antenna elements 211 in their respective operating frequency bands, so as to reduce a degree of the influence of their connection on the antenna performance. Moreover, the first connecting line 2210 between the two adjacent mm-wave antenna elements 211 may not filter and block the energy in non-mm-wave bands. Thus, the connection structure formed by connecting a plurality of mm-wave antenna elements 211 being multiplexed as the non-mm-wave antenna 22 or the first part 221 of the non-mm-wave antenna 22 may not affect the antenna performance of the non-mm-wave antenna 22.

In the embodiment of the present disclosure, the connection structure formed by at least two mm-wave antenna elements 211 by connection is multiplexed to form the non-mm-wave antenna 22 or the first part 221 of the non-mm-wave antenna 22, so that the mm-wave antenna 21 or a part of the mm-wave antenna 21 is enabled to also have the function of the non-mm-wave antenna 22. In this way, it is beneficial to reduce the number of cut regions of the conductive mesh and to reduce the differences between mesh patterns of different regions in the conductive mesh layer 101, to ensure a visual optical effect and a touch effect of the display screen 100.

Moreover, when the antenna 2 in the embodiment of the present disclosure adopts the above structure, a dimension of the antenna 2 may be effectively reduced, i.e., is smaller than a sum of dimensions of the types of antennas above the screen which are separately arranged. The influence of the antenna 2 on a visual optical effect and a touch effect of the display screen 100 may also be reduced, so as to increase functions and value of the display screen 100 with the ensured visual and tactile experience of users.

It is to be added that, in a plurality of mm-wave antenna elements 211 multiplexed to form the non-mm-wave antenna 22 or the first part 221 of the non-mm-wave antenna 22, any two adjacent mm-wave antenna elements 211 may be connected through one first connecting line 2210 or connected through a plurality of parallel first connecting lines 2210, provided that the first connecting line 2210 between two adjacent mm-wave antenna elements 211 can effectively block the mm-wave energy but not the non-mm-wave energy.

For example, referring to FIG. 6, a contour of any one of the mm-wave antenna elements 211 is a rectangle or a polygon having sides. In a plurality of mm-wave antenna elements 211 multiplexed to form the non-mm-wave antenna 22 or the first part 221 of the non-mm-wave antenna 22, the mm-wave antenna elements 211 are connected to each other through a plurality of first connecting lines 2210. For example, as shown in FIG. 6, any two adjacent mm-wave antenna elements 211 are connected through a plurality of parallel first connecting lines 2210. A sum of line widths of the plurality of first connecting lines 2210 is defined as a first size, a side length W of a side of the mm-wave antenna elements 211 correspondingly connected to the plurality of first connecting lines 2210 is defined as a second size, and the first size is less than or equal to one fourth of the second size.

Herein, a contour of the mm-wave antenna element 211 may be constructed as a polygon or other shapes, which is not limited in the embodiment of the present disclosure. In this situation, a sum of the line widths of the plurality of first connecting lines 2210 is defined as a first dimension, a size of the mm-wave antenna unit 211 in the line width direction of the first connecting line 2210 is defined as a second size, and the first size is less than or equal to one fourth of the second size.

Specifically, as shown in FIG. 6, in a plurality of mm-wave antenna elements 211 multiplexed to form the non-mm-wave antenna 22 or the first part 221 of the non-mm-wave antenna 22, any two adjacent mm-wave antenna elements 211 are connected through, for example, three first connecting lines 2210. Each first connecting line 2210 has a line width of D, and $3D \leq \frac{1}{4}W$.

It is to be noted that, in some embodiments, referring to FIG. 5 to FIG. 8, the non-mm-wave antenna 22 includes a first part 221, a second part 222 and a second connecting line 2220. The second connecting line 2220 is configured to connect the first part 221 and the second part 222. The second connecting line 2220 may be configured to block transmission of mm-wave energy between the mm-wave antenna element 211 and the second part 222 of the non-mm-wave antenna 22.

Herein, the number, the line length, and the line width of the second connecting line 2220 may be selectively set according to actual requirements, which is not limited in the embodiment of the present disclosure. Optionally, the second connecting line 2220 may be selectively set with reference to the structure of the first connecting line 2210.

In addition, in one possible implementation, the second part 222 of the non-mm-wave antenna 22 may be arranged adjacent to the mm-wave antenna 21, but is not limited thereto. For example, the second part 222 of the non-mm-wave antenna 22 may also be arranged around the mm-wave antenna 21.

On this basis, in the connection structure multiplexed to form the first part 221 of the non-mm-wave antenna 22, any two adjacent mm-wave antenna elements 211 are connected through at least one first connecting line 2210. The second part 222 of the non-mm-wave antenna 22 is connected to any mm-wave antenna element 211 in the connection structure through the second connecting line 2220.

Herein, a connection between the second part 222 and the first part 221 may be a series connection or a parallel connection, according to different structures and extension directions of the second part 222 of the non-mm-wave antenna 22.

In the present application, on the basis of multiplexing the connection structure to form the first part of the non-mm-wave antenna, the operating frequency (or frequencies) and bandwidth(s) of the non-mm-wave antenna can be reasonably controlled with the arrangement of the second part of the non-mm-wave antenna and the relative position relationship and the connection relationship between the second part and the first part.

In another possible implementation, the second part 222 of the non-mm-wave antenna 22 is constructed around the mm-wave antenna 21. In the connection structure multiplexed to form the first part 221 of the non-mm-wave antenna 22, the mm-wave antenna elements 211 are separately arranged and connected to the second part 222 of the non-mm-wave antenna 22 through the second connecting line 2220 respectively. In this way, the second part 222 of the non-mm-wave antenna 22 are connected in parallel with the mm-wave antenna elements 211 in the first part 221 thereof, so that the non-mm-wave antenna 22 may have a plurality of different resonant paths to have a plurality of different operating frequency bands, so as to realize multi-band communications of the non-mm-wave antenna 22.

In addition, compared to arranging the non-mm-wave antennas and the mm-wave antennas separately, in the embodiment of the present disclosure, the non-mm-wave antenna 22 includes a first part 221 and a second part 222 connected to each other, and the first part 221 of the non-mm-wave antenna 22 is formed by mm-wave antenna elements 211 by multiplexing, so dimensions of other components in the non-mm-wave antenna 22 other than the mm-wave antenna elements 211 in the first part 221, for example, a length of the second part 222 of the non-mm-wave antenna 22, may be reduced. That is, at a same operating frequency, the more the mm-wave antenna elements 211 that constitute the first part 221 are multiplexed in the non-mm-wave antenna 22, the shorter the length of other components in the non-mm-wave antenna 22 except the first part 221 may be. Thus, a cutting length of the conductive mesh configured to form the second part 222 of the non-mm-wave antenna 22 in the conductive mesh layer 101 may be reduced, so as to further ensure the visual optical effect and the touch effect of the display screen 100.

In addition, in some examples, referring to FIG. 4 to FIG. 6, the mm-wave antenna elements 211 may be single-polarization mm-wave antenna elements. In some other examples, referring to FIG. 7 and FIG. 8, the mm-wave antenna elements 211 may be dual-polarization mm-wave antenna elements. Moreover, optionally, referring to FIG. 4 to FIG. 8, according to different patterns of the conductive meshes in the conductive mesh layer 101, the contour of the mm-wave antenna element 211 may be in the shape of a rectangle, a diamond, or X-shape, and the contour of the second part 222 of the non-mm-wave antenna 22 may be in the shape of a stripe or L, which are not limited thereto. The shape of the contour of the mm-wave antenna element 211 and the shape of the contour of the second part 222 of the non-mm-wave antenna 22 are not limited in the embodiment of the present disclosure, which may be selectively set according to actual requirements.

It is to be added that, referring to FIG. 4 to FIG. 8, in the examples, the mm-wave antenna element 211 includes a main radiation portion (i.e., the rectangle portion shown in FIG. 4 to FIG. 6 or the diamond portion shown in FIG. 7 or the X portion shown in FIG. 8) and a mm-wave feeding portion (i.e., the strip portion configured to connect a mm-wave RFIC 300 shown in FIG. 4 to FIG. 8). Two sides of a junction between the mm-wave feeding portion and the corresponding main radiation portion in the mm-wave antenna element 211 are recessed in the main radiation portion of the mm-wave antenna element 211. For example, as shown in FIG. 4 to FIG. 7, the side edges of the rectangular main radiation portion connected to the strip-shaped feeding portion have notches, and the notches are arranged adjacent to the strip-shaped feeding portion on both sides of the strip-shaped feeding portion. This helps achieve better impedance matching of the antenna 2 and improve the antenna performance of the antenna 2.

In addition, referring to FIG. 2 and FIG. 4, in some examples, at least two mm-wave antenna elements 211 are connected to each other to form a connection structure, and the connection structure is multiplexed to form a non-mm-wave antenna 22. In this way, the non-mm-wave antenna 22 further includes a non-mm-wave feeding portion (i.e., a portion configured to connect a non-mm-wave RFIC 500, such as the non-mm-wave signal line $Ln_1$) connected to any one of the mm-wave antenna elements 211 multiplexed to form the non-mm-wave antenna 22. The non-mm-wave feeding portion is, for example, a feeding wire with the same structure as the first connecting line 2210. Alternatively, the non-mm-wave feeding portion includes, for example, a partial mesh pattern in the conductive mesh layer 101 and a feeding wire connected to the partial mesh pattern. The feeding wire may have the same structure as the first connecting line 2210 and be connected to the corresponding mm-wave antenna element 211. The mesh pattern is configured to connect the non-mm-wave RFIC 500.

Referring to FIG. 5 to FIG. 8, in some other examples, at least two mm-wave antenna elements 211 are connected to each other to form a connection structure, and the connection structure is multiplexed to form a first part 221 of a non-mm-wave antenna 22. Moreover, the non-mm-wave antenna 22 further includes a second part 222 connected to the first part 221. In this way, the second part 222 and the first part 221 of the non-mm-wave antenna 22 may share a same non-mm-wave feeding portion, for example, share a non-mm-wave feeding portion of the second part 222 (i.e., there is no need to arrange another non-mm-wave feeding portion in the first part 221). The non-mm-wave feeding portion of the second part 222 includes, for example, a partial mesh pattern in the conductive mesh layer 101. The non-mm-wave feeding portion of the second part 222 may be connected to any mm-wave antenna element 211 in the first part 221 through the second connecting line 2220.

Based on the above, in the embodiment of the present disclosure, the mm-wave antenna elements 211 of the mm-wave antenna 21 may be connected to the mm-wave RFIC 300 through their mm-wave feeding portions respectively, so as to respond to mm-wave RF signals transmitted by the mm-wave RFIC 300 to realize a mm-wave antenna function. The non-mm-wave antenna 22 may be connected to the non-mm-wave RFIC 500 through its non-mm-wave feeding portion, so as to respond to non-mm-wave RF signals transmitted by the non-mm-wave RFIC 500 to realize a non-mm-wave antenna function.

Based on this, it may be understood that the mm-wave RFIC 300 and the non-mm-wave RFIC 500 may be electrically bonded to an FPC 200, so as to be correspondingly electrically bonded to the antenna 2 integrated to the display screen 100 through the FPC 200. Alternatively, the mm-wave RFIC 300 may be electrically bonded to the FPC 200, the non-mm-wave RFIC 500 may be electrically bonded to a PCB 20, and the FPC 200 is correspondingly electrically bonded to the antenna 2 in the display screen 100 and the PCB 20. Therefore, the mm-wave antenna 21 and the non-mm-wave antenna 22 in the antenna 2 can have independent communication links, and the mm-wave antenna 21 and the non-mm-wave antenna 22 can work at the same time without affecting each other.

In order to further understand the present application, the specific structure of the antenna 2, especially the specific structure of the non-mm-wave antenna 22, is described in detail in some embodiments below. It may be understood that the structure of the non-mm-wave antenna 22 may be implemented in many different manners according to different operating frequencies and bandwidths (i.e., the width of the operating frequency band) of the non-mm-wave antenna 22.

In one possible implementation, a plurality of mm-wave antenna elements 211 multiplexed to form the first part 221 of the non-mm-wave antenna 22 are connected in series.

In some embodiments, referring to FIG. 9 to FIG. 13, the second part 222 of the non-mm-wave antenna 22 is located on one side of the mm-wave antenna 21, and the second part 222 of the non-mm-wave antenna 22 is connected to the mm-wave antenna element 211 which is multiplexed to form the first part 221 of the non-mm-wave antenna 22 and closest to the second part 222. In this way, the second part 222 of the non-mm-wave antenna 22 is sequentially connected in series with the mm-wave antenna elements 211 multiplexed to form the first part 221 of the non-mm-wave antenna 22 to form the non-mm-wave antenna 22.

Figure 9:
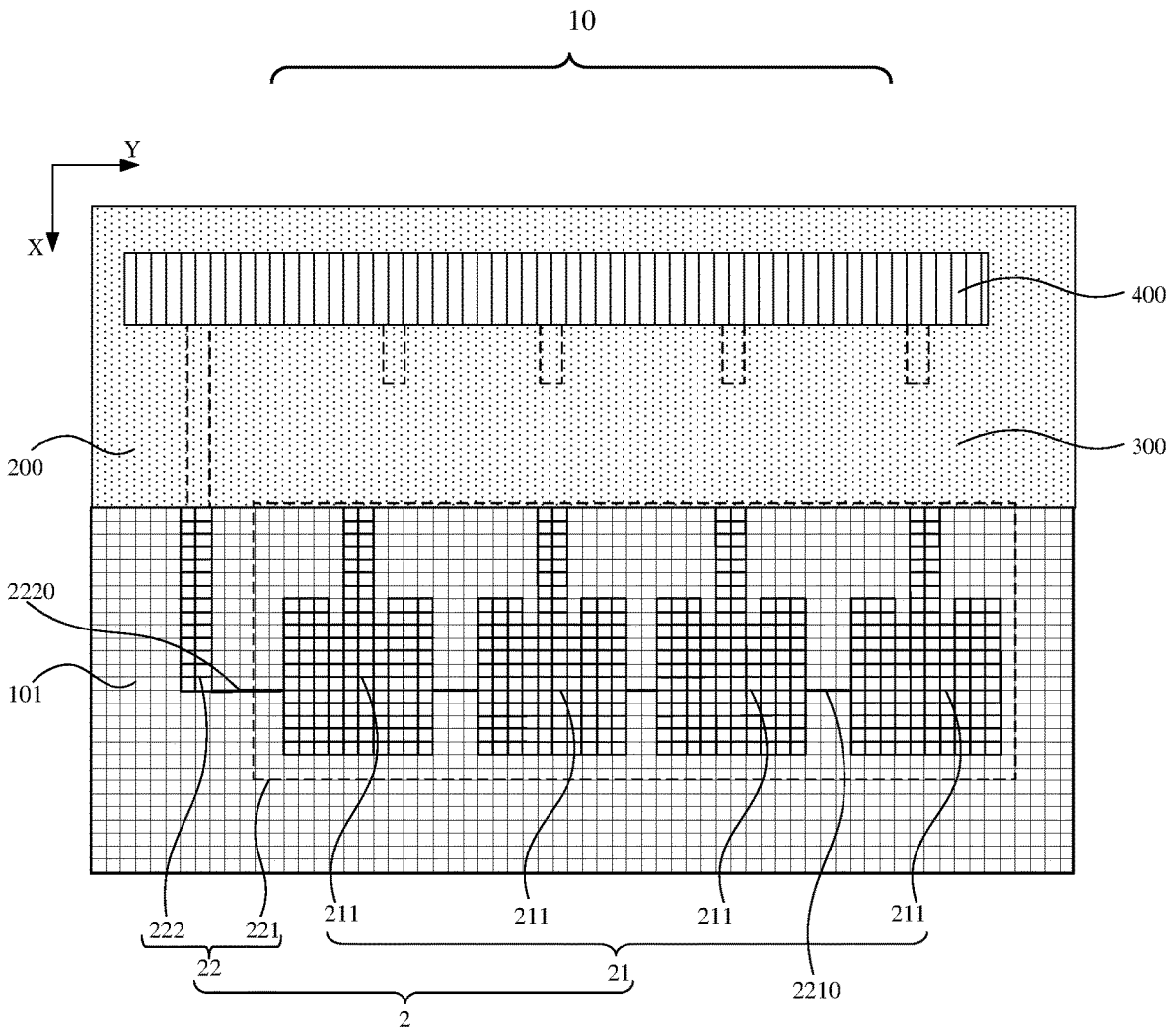
FIG. 9 is a schematic structural diagram of a display apparatus 10.
Figure 10:
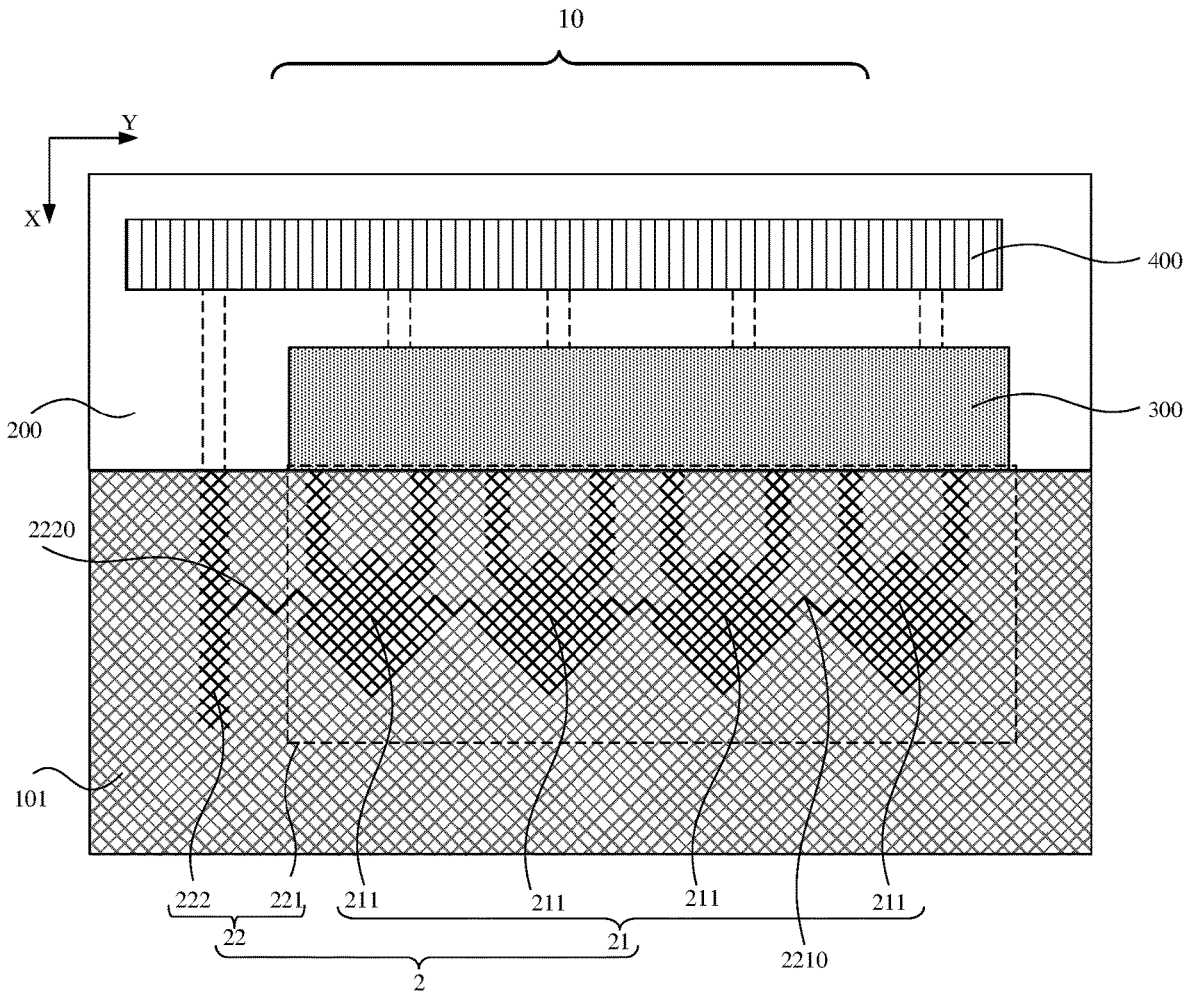
FIG. 10 is a schematic structural diagram of another display apparatus 10.

For example, the second part 222 of the non-mm-wave antenna 22 may be formed by conductive meshes with rectangular or L-shaped contours. The second part 222 of the non-mm-wave antenna 22 is connected through the second connecting line 2220 to the mm-wave antenna element 211 multiplexed to form the first part 221 of the non-mm-wave antenna 22 where the mentioned connected mm-wave antenna element 211 is the one closest to the second part 222. As one implementation, the second connecting line 2220 may be connected to an end portion (such as a first section or a final section) of the second part 222 of the non-mm-wave antenna 22, as shown in FIG. 9. As another implementation, the second connecting line 2220 may be connected to a middle section of the second part 222 of the non-mm-wave antenna 22, as shown in FIG. 10. Herein and in the following description, the first section of the second part 222 is the non-mm-wave feeding portion of the second part 222.

Figure 11:
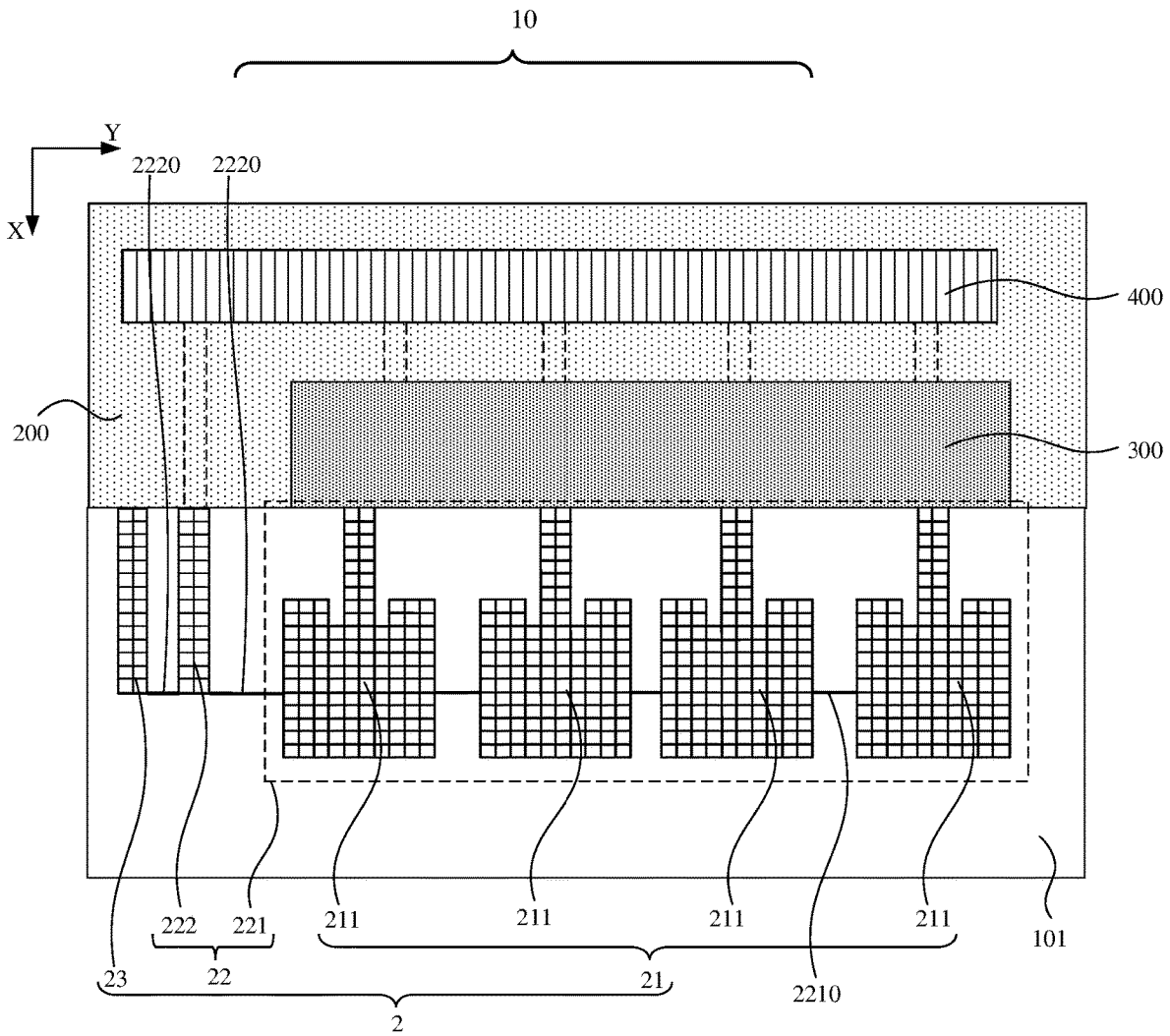
FIG. 11 is a schematic structural diagram of yet another display apparatus 10.
Figure 12:
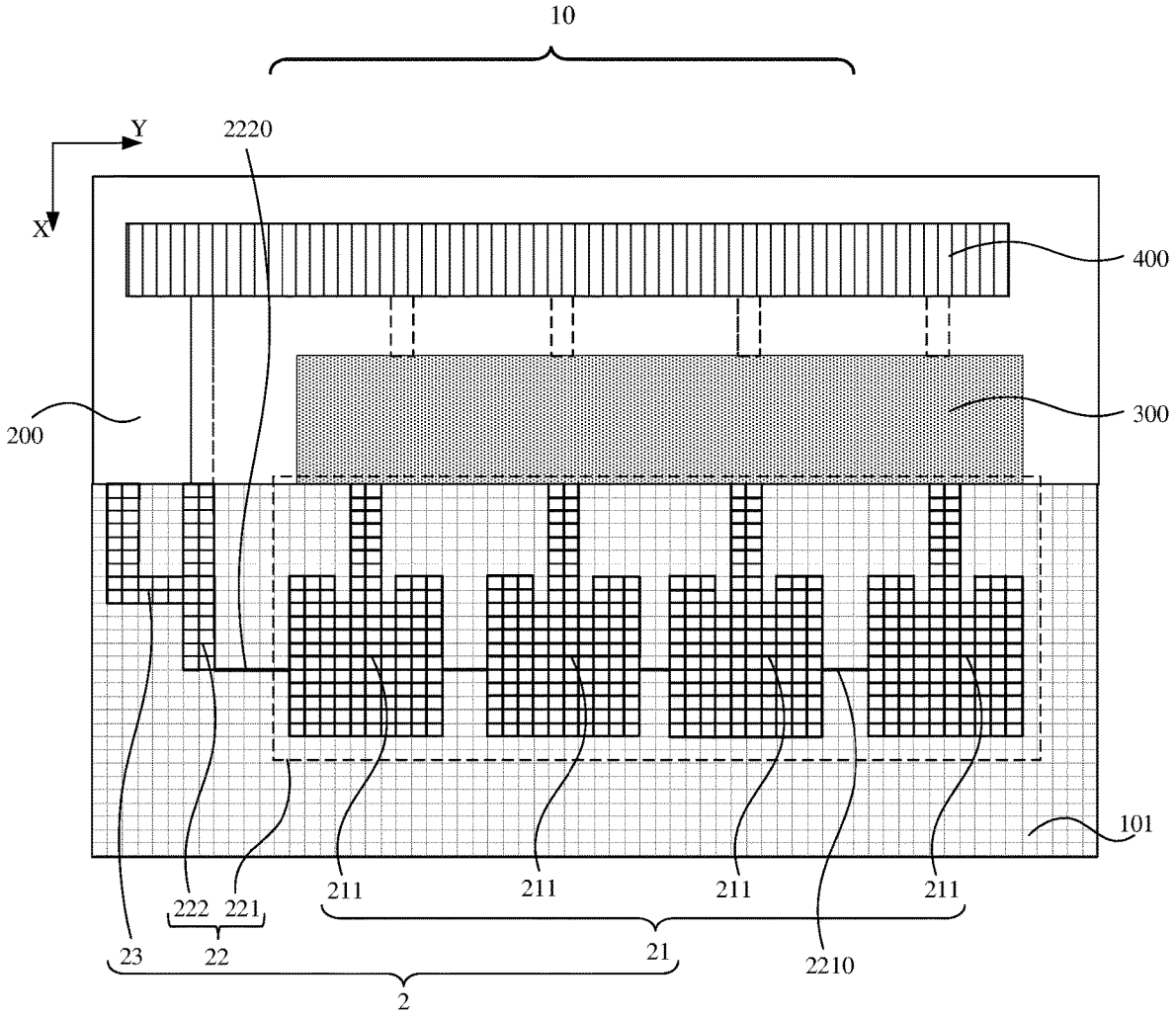
FIG. 12 is a schematic structural diagram of still another display apparatus 10.
Figure 13:
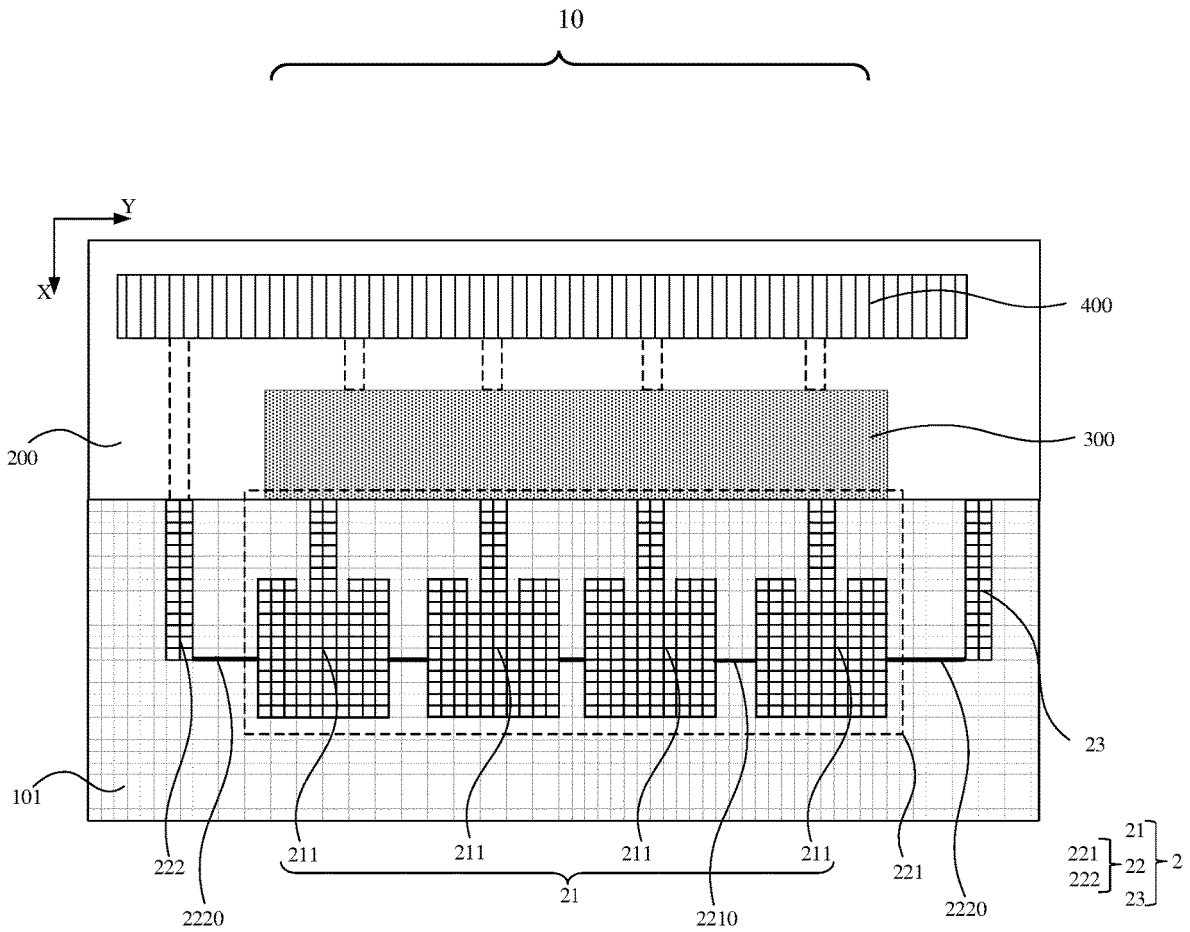
FIG. 13 is a schematic structural diagram of a further display apparatus 10.

On the basis of some embodiments above, optionally, referring to FIG. 11 to FIG. 13, the second part 222 of the non-mm-wave antenna 22 is located on one side of the mm-wave antenna 21. The antenna 2 further includes a grounding portion 23. The grounding portion 23 may be connected to a grounding wire or grounding plane in the FPC 200. The grounding portion 23 may specifically be implemented in some following manners.

In some examples, the grounding portion 23 is located on one side of the second part 222 of the non-mm-wave antenna 22 away from the mm-wave antenna 21 and connected to the second part 222. As one implementation, the grounding portion 23 may be connected to the second part 222 of the non-mm-wave antenna 22 through at least one second connecting line 2220, as shown in FIG. 11. As another implementation, the grounding portion 23 may be directly connected to the second part 222 of the non-mm-wave antenna 22 (i.e., the grounding portion 23 may be integrated with the second part 222 of the non-mm-wave antenna 22), as shown in FIG. 12.

In addition, optionally, the second part 23 may be formed by conductive meshes with rectangular or L-shaped contours. The grounding portion 23 may be connected to an end portion (such as the first section or the final section) or the middle section of the second part 222 of the non-mm-wave antenna 22. Moreover, in one implementation, the grounding portion 23 and the second part 222 of the non-mm-wave antenna 22 may have a same contour shape.

In some other examples, referring to FIG. 13, the grounding portion 23 is located on one side of the mm-wave antenna 21 away from the second part 222 of the non-mm-wave antenna 22 (for example, as shown in FIG. 13, the grounding portion 23 and the second part 222 of the non-mm-wave antenna 22 are respectively located on two sides of the first part 221 of the non-mm-wave antenna 22), and is connected through at least one second connecting line 2220 to any one of the plurality of mm-wave antenna elements 211 multiplexed to form the first part 221 of the non-mm-wave antenna 22. For example, the grounding portion 23 is connected through one second connecting line 2220 to the mm-wave antenna element 211 multiplexed to form the first part 221 of the non-mm-wave antenna 22 where the mentioned connected mm-wave antenna element 211 is the one closest to the grounding portion 23. In this way, the second part 222 and the first part 221 of the non-mm-wave antenna 22 are sequentially connected in series with the grounding portion 23. The grounding portion 23 can be used to enable the non-mm-wave antenna 22 to have a longer length, so as to cover lower antenna operating frequencies.

Figure 14:
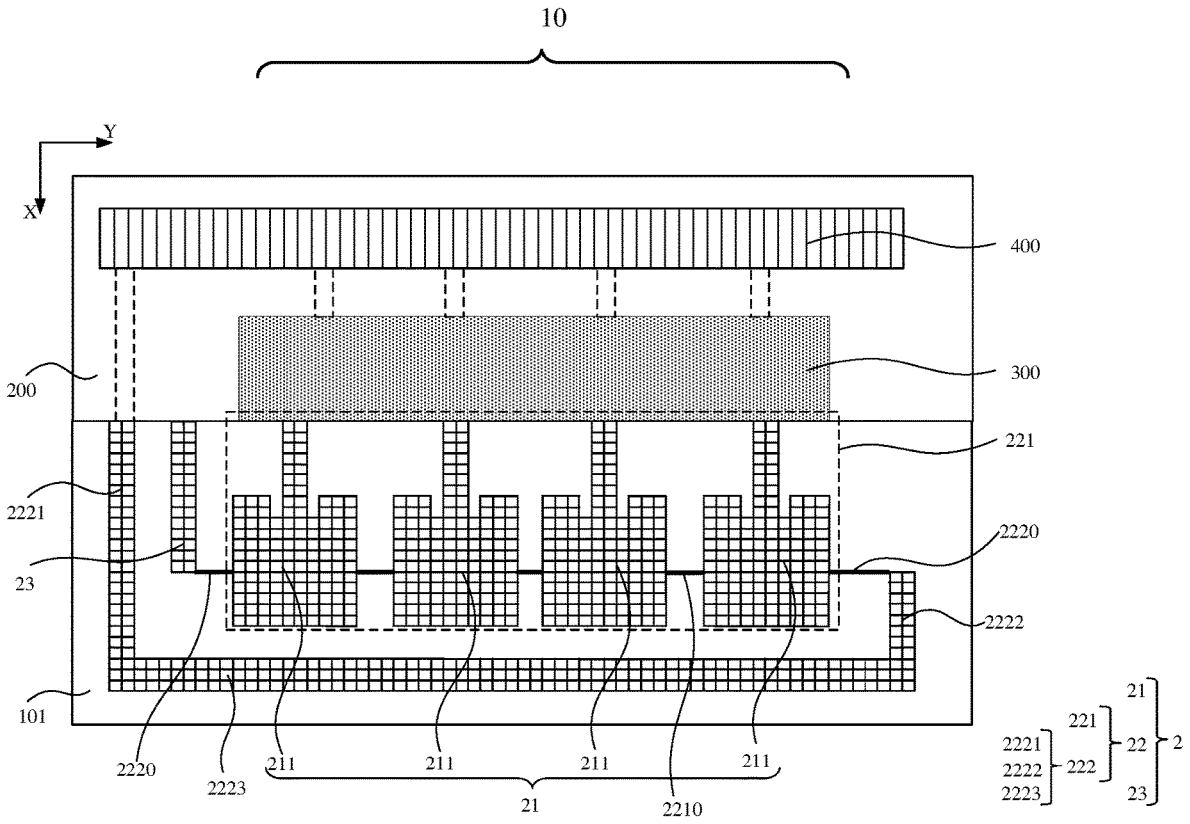
FIG. 14 is a schematic structural diagram of a further display apparatus 10.

In some other examples, referring to FIG. 14, the grounding portion 23 is located between the mm-wave antenna 21 and the second part 222 of the non-mm-wave antenna 22, and is connected to any mm-wave antenna element 211 in the first part 221 of the non-mm-wave antenna 22 through the second connecting line 2210. For example, the grounding portion 23 is connected to the nearest mm-wave antenna element 211 in the first part 221 of the non-mm-wave antenna 22.

Optionally, the second part 222 of the non-mm-wave antenna 22 is constructed around the corresponding mm-wave antenna 21, and connected, through at least one second connecting line 2220, to any one of the plurality of mm-wave antenna elements 211 multiplexed to form the first part 221 of the non-mm-wave antenna 22. The contour of the second part 222 of the non-mm-wave antenna 22 may be in the shape of a rectangle, an L, or others.

For example, the second part 222 of the non-mm-wave antenna 22 semi-surrounds the corresponding mm-wave antenna 21. Herein, "semi-surround" means that the second part 222 of the non-mm-wave antenna 22 has parts facing to each other on at least two sides of the mm-wave antenna 21. Exemplarily, as shown in FIG. 14, the second part 222 of the non-mm-wave antenna 22 surrounds at least three sides of the corresponding mm-wave antenna 21. For example, the second part 222 of the non-mm-wave antenna 22 includes a first section 2221, a final section 2222 and a middle section 2223 connected between the first section 2221 and the final section 2222. The first section 2221 is configured to be connected to the non-mm-wave RFIC 500, for example, connected to the non-mm-wave transmission line $Ln_2$ in the FPC 200. The final section 2222 is connected to the mm-wave antenna element 211 multiplexed to form the first part 221 of the non-mm-wave antenna 22 where the mentioned connected mm-wave antenna element 211 is the one closest to the final section 2222 through the second connecting line 2220. In this way, the second part 222 of the non-mm-wave antenna 22 may be connected in series with the first part 221 of the non-mm-wave antenna 22 formed by multiplexing, and the non-mm-wave antenna 22 using this structure is ensured to have a longer length and a larger area in a limited space range, so as to reasonably control the operating frequency and bandwidth of the non-mm-wave antenna 22.

On this basis, still referring to FIG. 14, the first section 2221 and the final section 2222 of the second part 222 of the non-mm-wave antenna 22 are located on two opposite sides of the mm-wave antenna 21 respectively. The grounding portion 23 is located between the first section 2221 of the second part 222 of the non-mm-wave antenna 22 and the mm-wave antenna 21, and is connected, through at least one second connecting line 2220, to any one of the plurality of mm-wave antenna elements 211 multiplexed to form the first part 221 of the non-mm-wave antenna 22. For example, the grounding portion 23 is connected, through one second connecting line 2220, to the nearest mm-wave antenna element 211 multiplexed to form the first part 221 of the non-mm-wave antenna 22. In this way, the length and the area of the non-mm-wave antenna 22 may be further controlled by providing the grounding portion 23 with different lengths and areas in a limited space range, so as to adjust the operating frequency and bandwidth of the non-mm-wave antenna 22.

In some other examples, referring to FIG. 3, at least two non-mm-wave antennas 22 are provided, and the grounding portion 23 is located between two adjacent non-mm-wave antennas 22. In this way, the grounding portion 23 may be used as an isolation portion 24 between the corresponding two adjacent non-mm-wave antennas 22, so as to effectively prevent mutual interference between the adjacent non-mm-wave antennas 22. Thus, each non-mm-wave antenna 22 is ensured to have better antenna performance.

Figure 15:
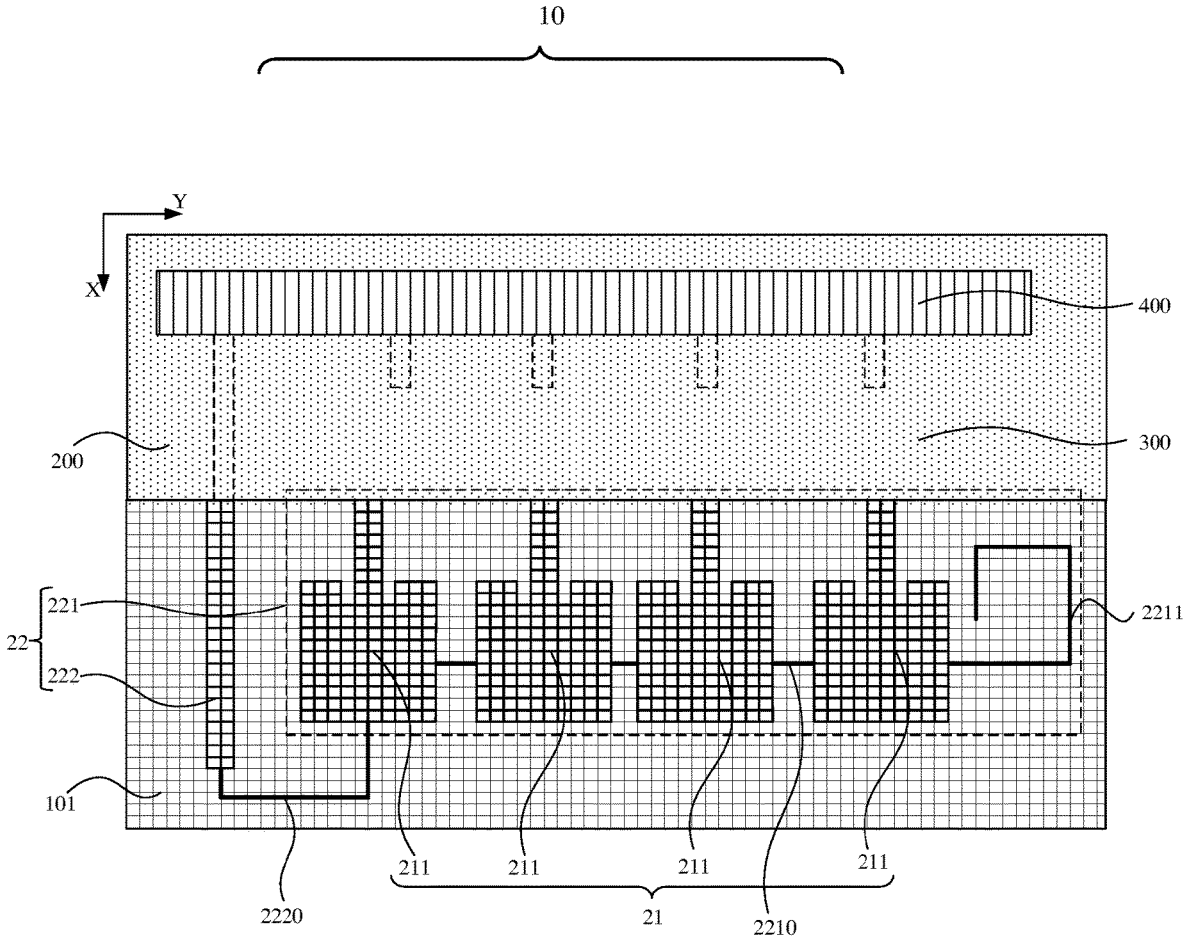
FIG. 15 is a schematic structural diagram of a further display apparatus 10.

On the basis of some embodiments above, optionally, referring to FIG. 15, the first part 221 of the non-mm-wave antenna 22 further includes an extension portion 2211. One end of the extension portion 2211 is connected to any one of the plurality of mm-wave antenna elements 211 multiplexed to form the first part 221 of the non-mm-wave antenna 22, and the other end of the extension portion 2211 is suspended.

The extension portion 2211 may specifically be implemented in some following manners.

In some examples, still referring to FIG. 15, the second part 222 of the non-mm-wave antenna 22 is located on one side of the mm-wave antenna 21. The extension portion 2211 is located on one side of the mm-wave antenna 21 away from the second part 22 of the non-mm-wave antenna 22, and is connected to any one of the plurality of mm-wave antenna elements 211 multiplexed to form the first part 221 of the non-mm-wave antenna 22. For example, the extension portion 2211 is directly connected to the mm-wave antenna element 211 multiplexed to form the first part 221 of the non-mm-wave antenna 22 and closest to the extension portion 2211. In the example shown in FIG. 15, one end of the extension portion 2211 is connected to the mm-wave antenna unit 211 on the side of the first part 221 of the non-mm-wave antenna 22 farthest from the second part 222 of the non-mm-wave antenna 22.

Figure 16:
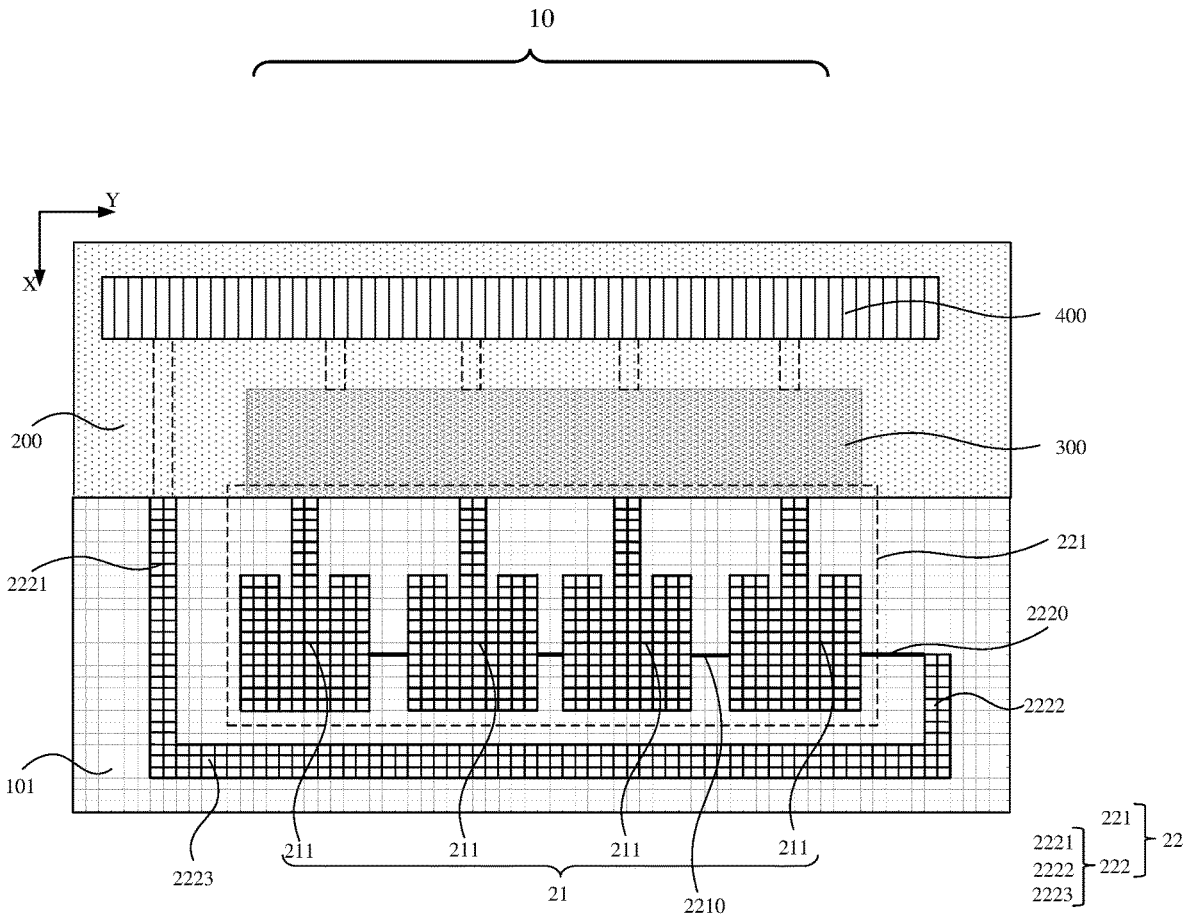
FIG. 16 is a schematic structural diagram of a further display apparatus 10.
Figure 17:
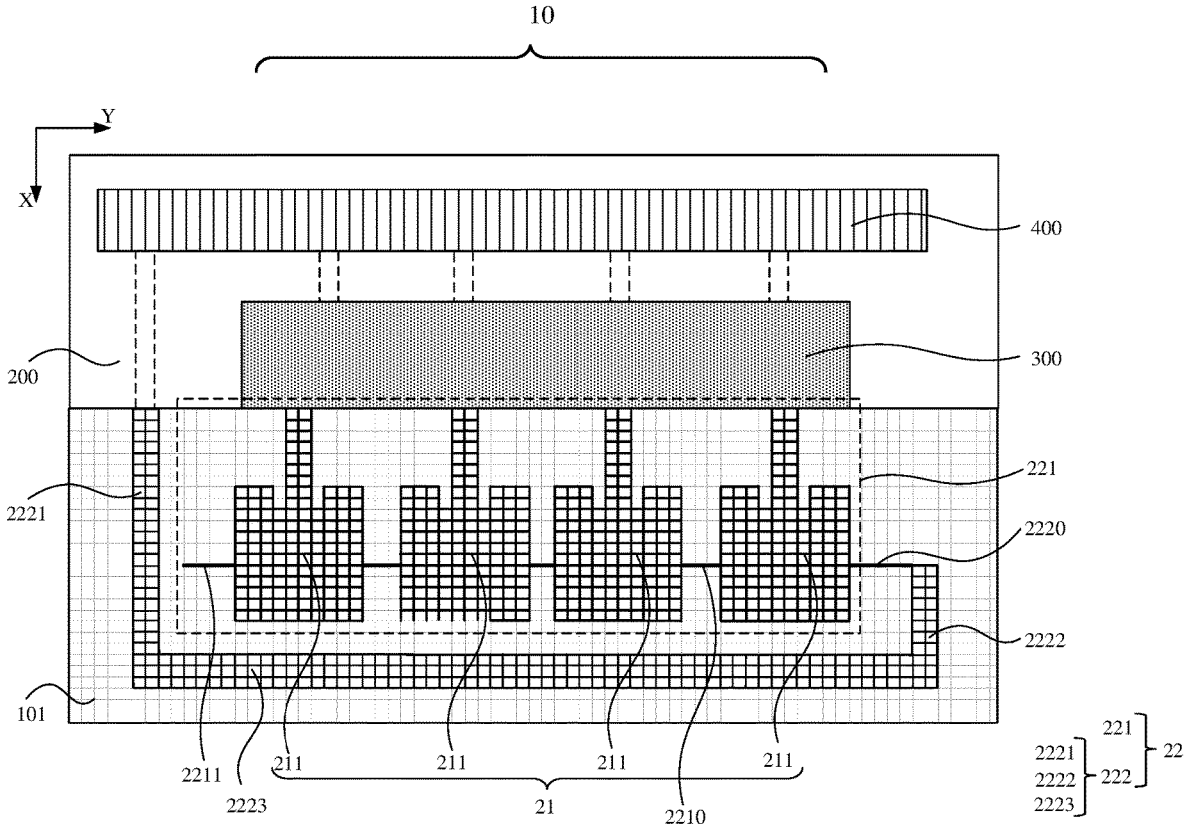
FIG. 17 is a schematic structural diagram of a further display apparatus 10.

In some other examples, referring to FIG. 16 and FIG. 17, the second part 222 of the non-mm-wave antenna 22 is arranged around the corresponding mm-wave antenna 21, and connected, through at least one second connecting line 2220, to any one of the plurality of mm-wave antenna elements 211 multiplexed to form the first part 221 of the non-mm-wave antenna 22.

Optionally, as shown in FIG. 16, the second part 222 of the non-mm-wave antenna 22 includes a first section 2221, a final section 2222 and a middle section 2223 connected between the first section 2221 and the final section 2222. The first section 2221 is configured to be connected to the non-mm-wave RFIC 500, for example, connected to the non-mm-wave transmission line $Ln_2$ in the FPC 200. The final section 2222 is connected to the mm-wave antenna element 211 multiplexed to form the first part 221 of the non-mm-wave antenna 22 where the mentioned connected mm-wave antenna element 211 is the one closest to the final section 2222. In this way, the second part 222 of the non-mm-wave antenna 22 may be connected in series with the first part 221 of the non-mm-wave antenna 22 formed by multiplexing, and the non-mm-wave antenna 22 using this structure is ensured to have a longer length and a larger area in a limited space range, so as to reasonably control the operating frequency and bandwidth of the non-mm-wave antenna 22.

On this basis, referring to FIG. 17, the first section 2221 and the final section 2222 of the second part 222 of the non-mm-wave antenna 22 are located on two sides of the mm-wave antenna 21 respectively. The extension portion 2211 is located between the first section 2221 of the second part 222 of the non-mm-wave antenna 22 and the mm-wave antenna 21, and is connected to any one of the plurality of mm-wave antenna elements 211 multiplexed to form the first part 221 of the non-mm-wave antenna 22. For example, the extension portion 2211 is directly connected to the mm-wave antenna element 211 multiplexed to form the first part 221 of the non-mm-wave antenna 22 where the mentioned connected mm-wave antenna element 211 is the one closest to the extension portion 2211.

Optionally, the extension portion 2211 may comprise at least one first connecting line 2210 with one end suspended. In this way, the first part 221 of the non-mm-wave antenna 22 is enabled to have different lengths by providing the extension portion 2211 with different lengths, so as to control the operating frequency of the first part 221 of the non-mm-wave antenna 22. For example, the longer the length of the first part 221 of the non-mm-wave antenna 22, the lower the operating frequency that it may cover. In addition, the extension portion 2211 also helps to optimize the impedance and improve the antenna performance.

It is to be added that, in some embodiments where the plurality of mm-wave antenna elements 211 are connected in series to be multiplexed to form the first part 221 of the non-mm-wave antenna 22, the second part 222 of the non-mm-wave antenna 22 may also have arrangements other than those in some embodiments above.

Figure 18:
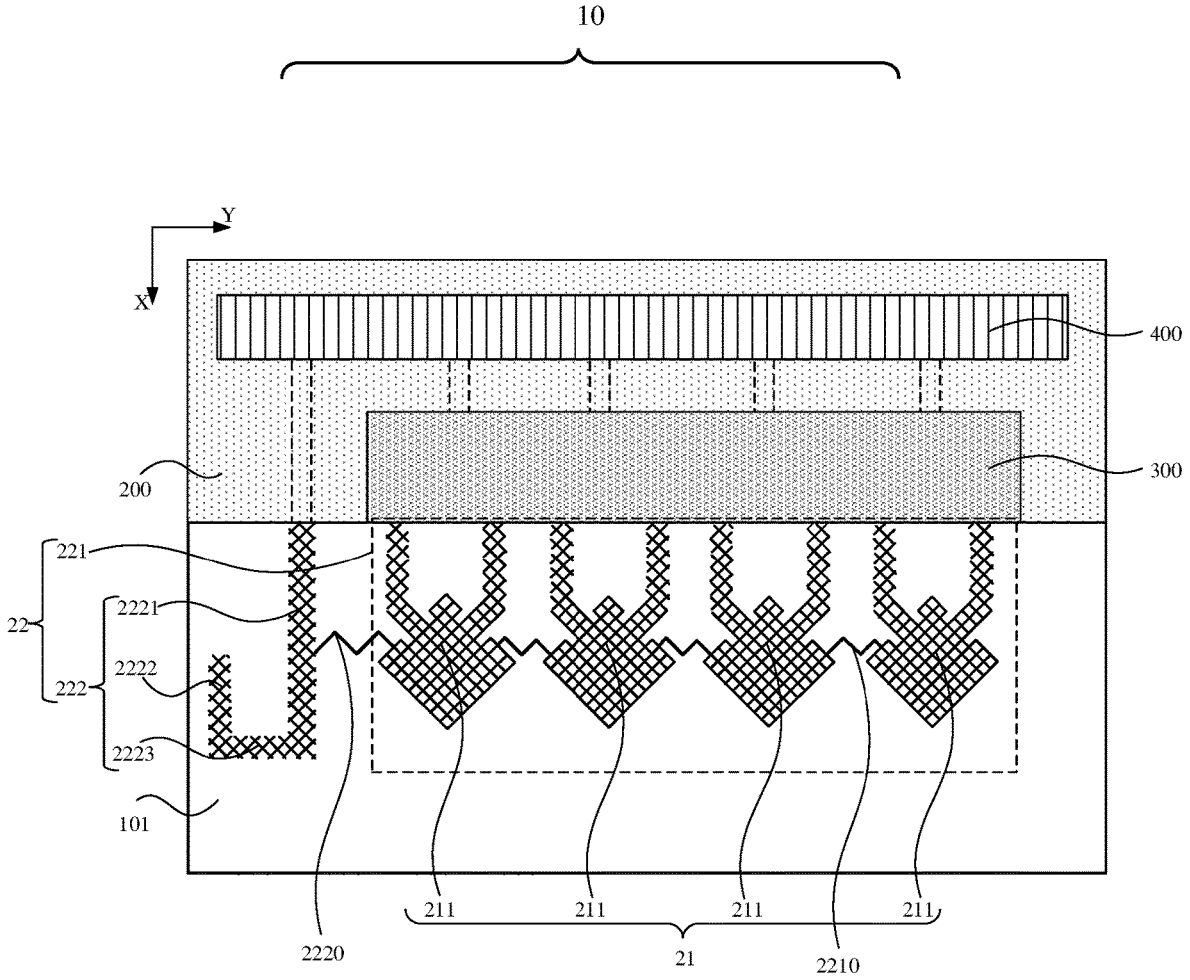
FIG. 18 is a schematic structural diagram of a further display apparatus 10.

For example, referring to FIG. 18, the second part 222 of the non-mm-wave antenna 22 includes a first section 2221, a final section 2222 and a middle section 2223 connected between the first section 2221 and the final section 2222. The first section 2221 is connected to any one of the plurality of mm-wave antenna elements 211 multiplexed to form the first part 221 of the non-mm-wave antenna 22, and configured to be connected to the non-mm-wave RFIC 500, for example, connected to the non-mm-wave transmission line $Ln_2$ in the FPC 200. The final section 2222 is located on one side of the first section 2221 away from the mm-wave antenna 21. For example, the mm-wave antenna 21 is located on a right side of the second part 222 of the non-mm-wave antenna 22, and the second part 222 of the non-mm-wave antenna 22 extends to a left side. In this way, the second part 222 of the non-mm-wave antenna 22 is connected in parallel with the first part 221 thereof, which may increase resonant paths of the non-mm-wave antenna 22, so as to enhance the antenna performance of the non-mm-wave antenna 22. For example, the non-mm-wave antenna 22 is enabled to cover more operating frequency bands.

Figure 19:
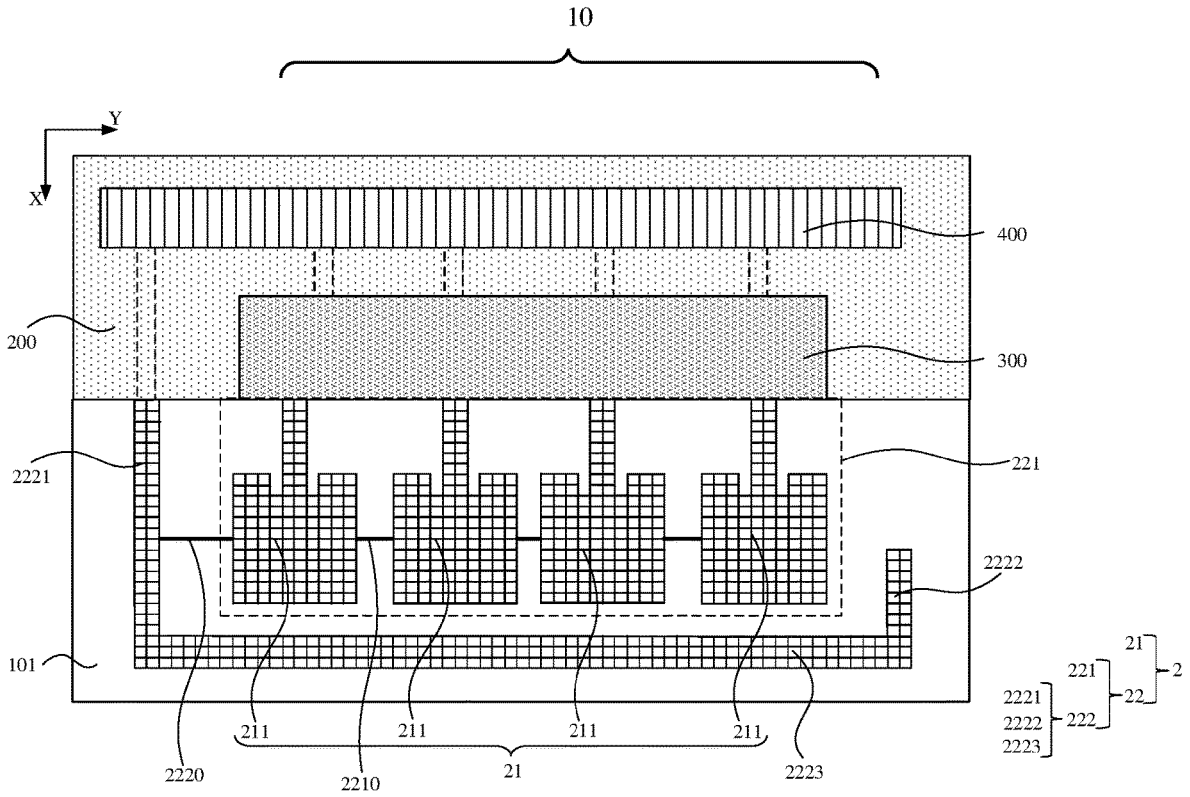
FIG. 19 is a schematic structural diagram of a further display apparatus 10.
Figure 20:
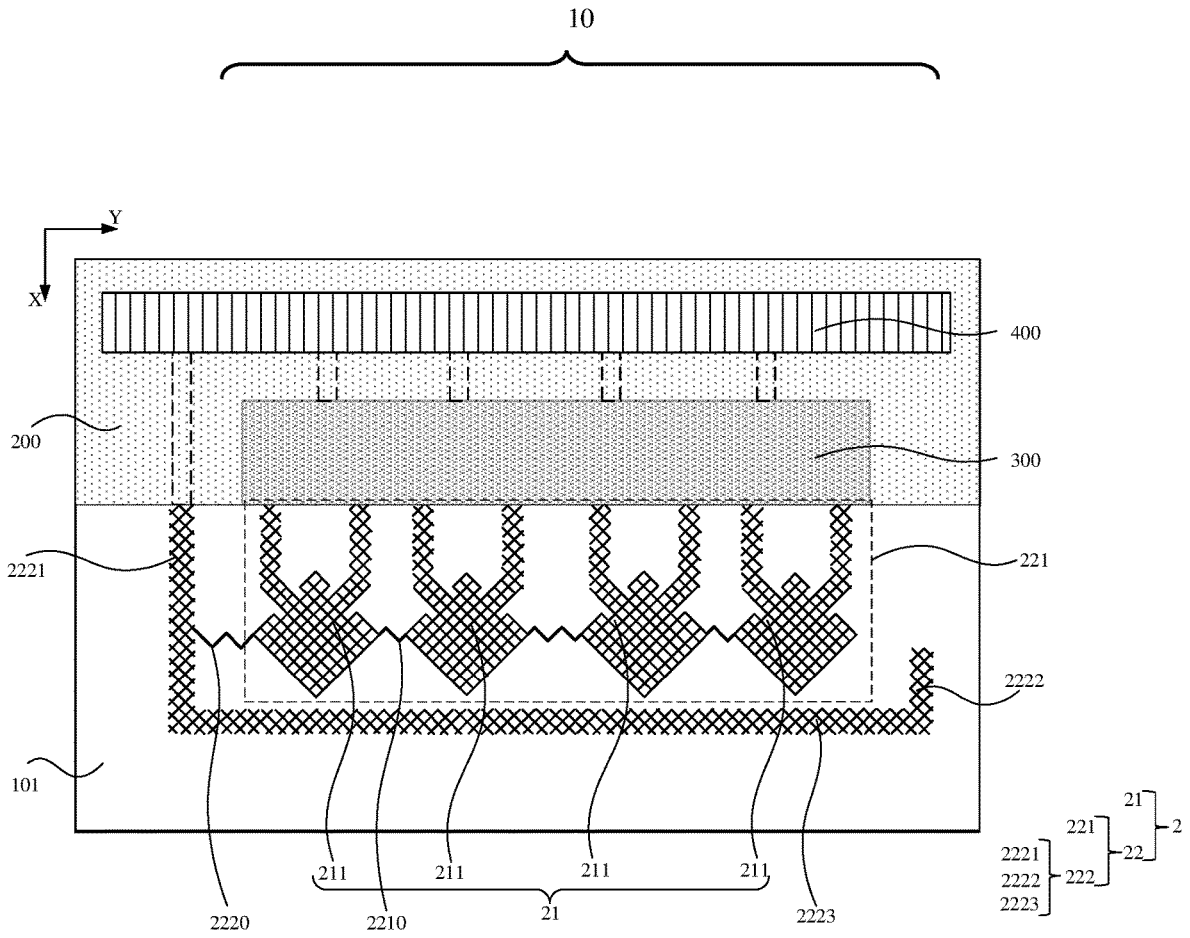
FIG. 20 is a schematic structural diagram of a further display apparatus 10.

For example, referring to FIG. 19 and FIG. 20, the non-mm-wave antenna 22 further includes a second part 222 and a plurality of second connecting lines 2210. In FIG. 19, the mm-wave antenna elements 211 are single-polarization mm-wave antenna elements. In FIG. 20, the mm-wave antenna elements 211 are dual-polarization mm-wave antenna elements. The second part 222 of the non-mm-wave antenna 22 is constructed around the corresponding mm-wave antenna 21. Any two adjacent mm-wave antenna elements 211 in the plurality of mm-wave antenna elements 211 multiplexed to form the first part 221 of the non-mm-wave antenna 22 are connected through at least one first connecting line 2210. The first connecting line 2210 is configured to block transmission of mm-wave energy between the any two adjacent mm-wave antenna elements 211. Moreover, the second part 222 of the non-mm-wave antenna 22 includes a first section 2221 configured to be connected to the non-mm-wave RFIC 500. The mm-wave antenna element 211 multiplexed to form the first part 221 of the non-mm-wave antenna 22 and closest to the first section 2221 may be connected to the first section 2221 through at least one second connecting line 2220 (such as one second connecting line 2220). The second connecting line 2220 is configured to block transmission of mm-wave energy between the mm-wave antenna element 211 and the second part 222 of the non-mm-wave antenna 22. Furthermore, the first part 221 and the second part 222 of the non-mm-wave antenna 22 extend in a same direction. For example, taking a connecting part of the first part 221 and the second part 222 as a base point, the first part 221 and the second part 222 extend from left to right to be connected in parallel. In this way, the non-mm-wave antenna 22 may have different resonant paths to have different operating frequency bands, so as to realize multi-band communications of the non-mm-wave antenna 22.

Figure 21:
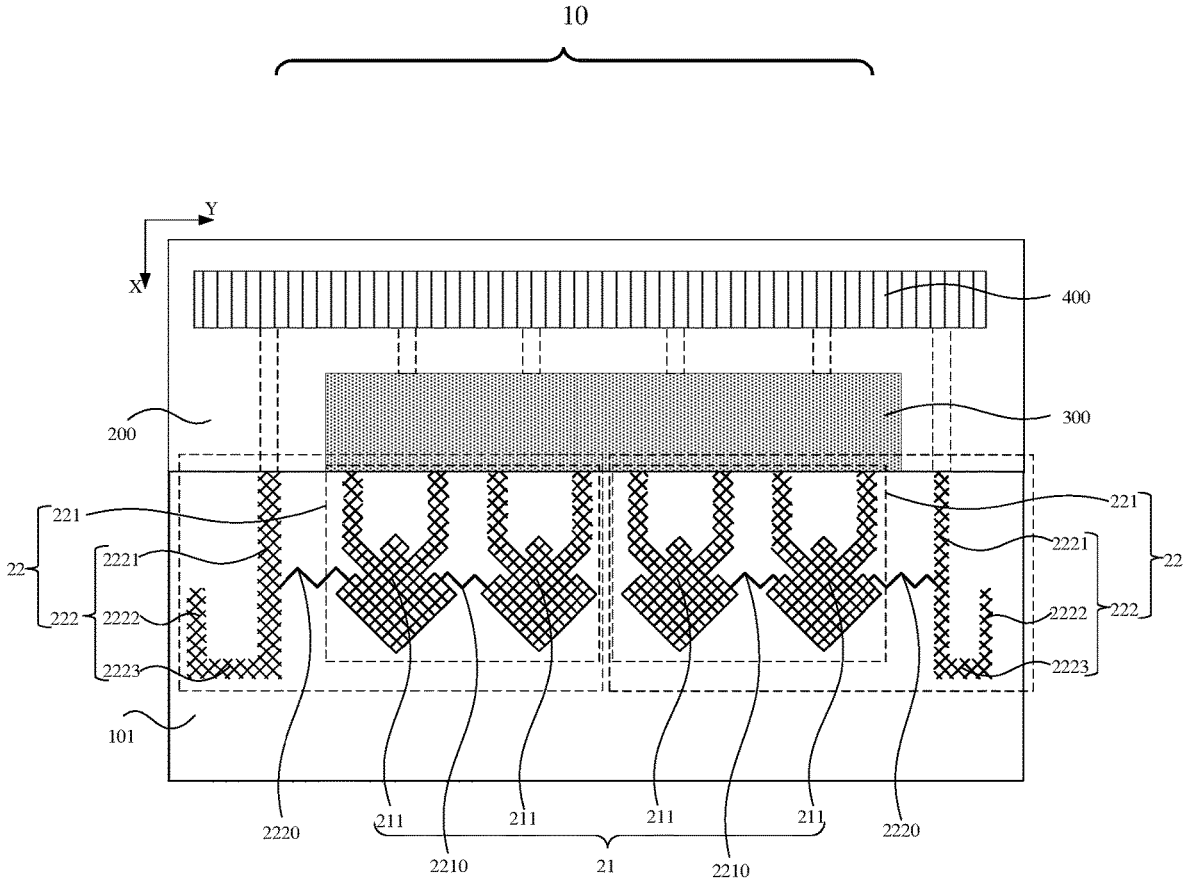
FIG. 21 is a schematic structural diagram of a further display apparatus 10.
Figure 22:
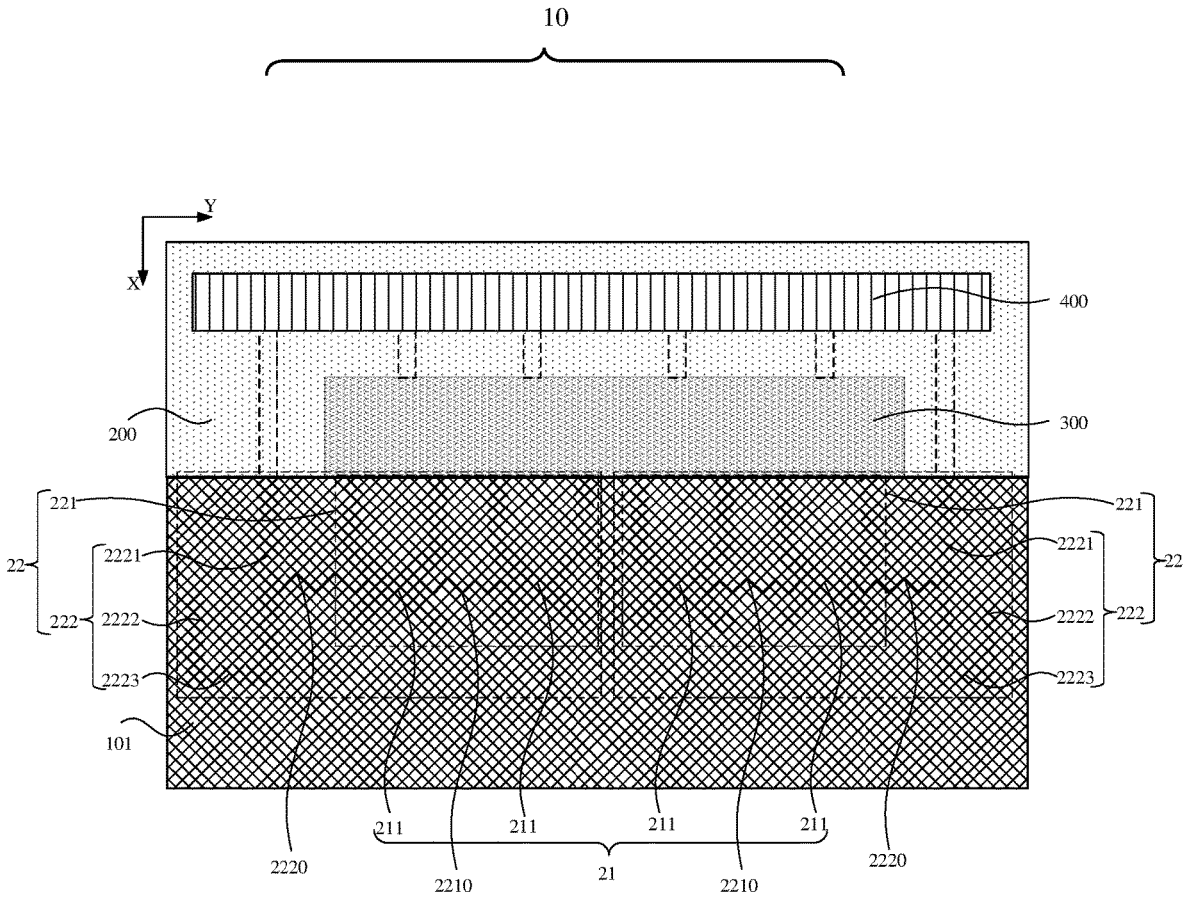
FIG. 22 is a schematic structural diagram of a further display apparatus 10.

On the basis of some embodiments above, optionally, referring to FIG. 21, the antenna 2 includes at least two non-mm-wave antennas 22. Based on this, the second parts 22 in different non-mm-wave antennas 22 may have same or different structures. In this way, different mm-wave antenna elements 211 in a same mm-wave antenna 21 can be multiplexed to form two or more non-mm-wave antennas 22 or form first parts 221 of two or more non-mm-wave antennas 22.

For example, two non-mm-wave antennas 22 are provided, and the two non-mm-wave antennas 22 are arranged as mirror images.

For example, as shown in FIG. 21, the second parts 222 in different non-mm-wave antennas 22 may have different structures. For example, the non-mm-wave antennas 22 may be controlled to have different operating frequencies and bandwidths by providing the second parts 222 of the non-mm-wave antennas 22 with different contour shapes and extension lengths. That is, the antenna 2 may have at least two different types of non-mm-wave antennas 22 at the same time.

In addition, referring to FIG. 19 to FIG. 22, optionally, the contour of the mm-wave antenna element 211 may be in the shape of a rectangle, a diamond, X-shape or the like. In this way, by providing the mm-wave antenna element 211 with different contour shapes, the first part 221 of the non-mm-wave antennas 22 formed by multiplexing thereof may also be controlled correspondingly to have different operating frequency bands. For example, the larger the area of the mm-wave antenna element 211, the lower the operating frequency band or the wider the bandwidth of the first part 221 of the non-mm-wave antennas 22 formed by multiplexing thereof.

Figure 23:
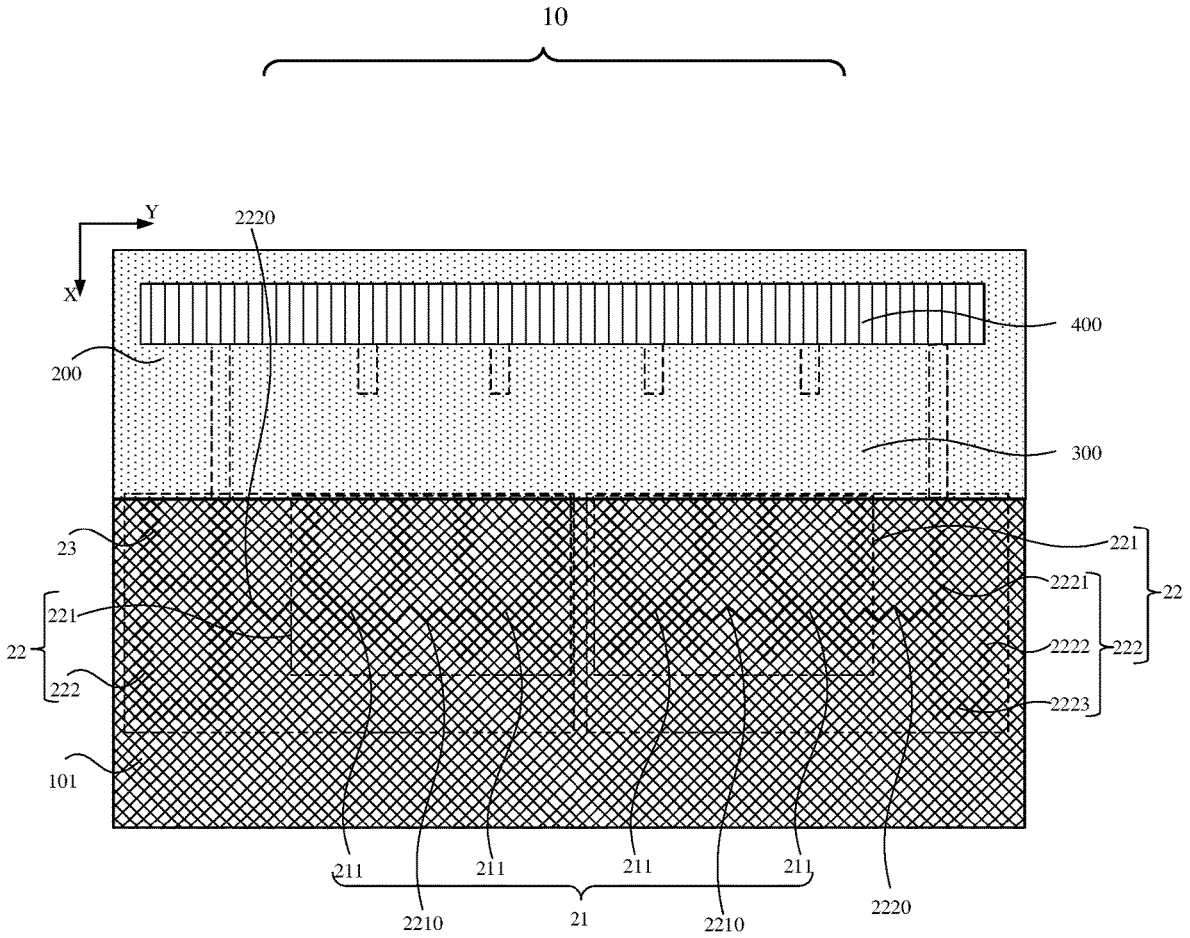
FIG. 23 is a schematic structural diagram of a further display apparatus 10.

In addition, optionally, referring to FIG. 23, at least one of the plurality of non-mm-wave antennas 22 is further connected to the grounding portion 23. The grounding portion 23 may be connected to a grounding wire or grounding plane in the FPC 200. The setting of the grounding portion 23 may be obtained with reference to the relevant description in some embodiments above, and is not described in detail herein.

Figure 24:
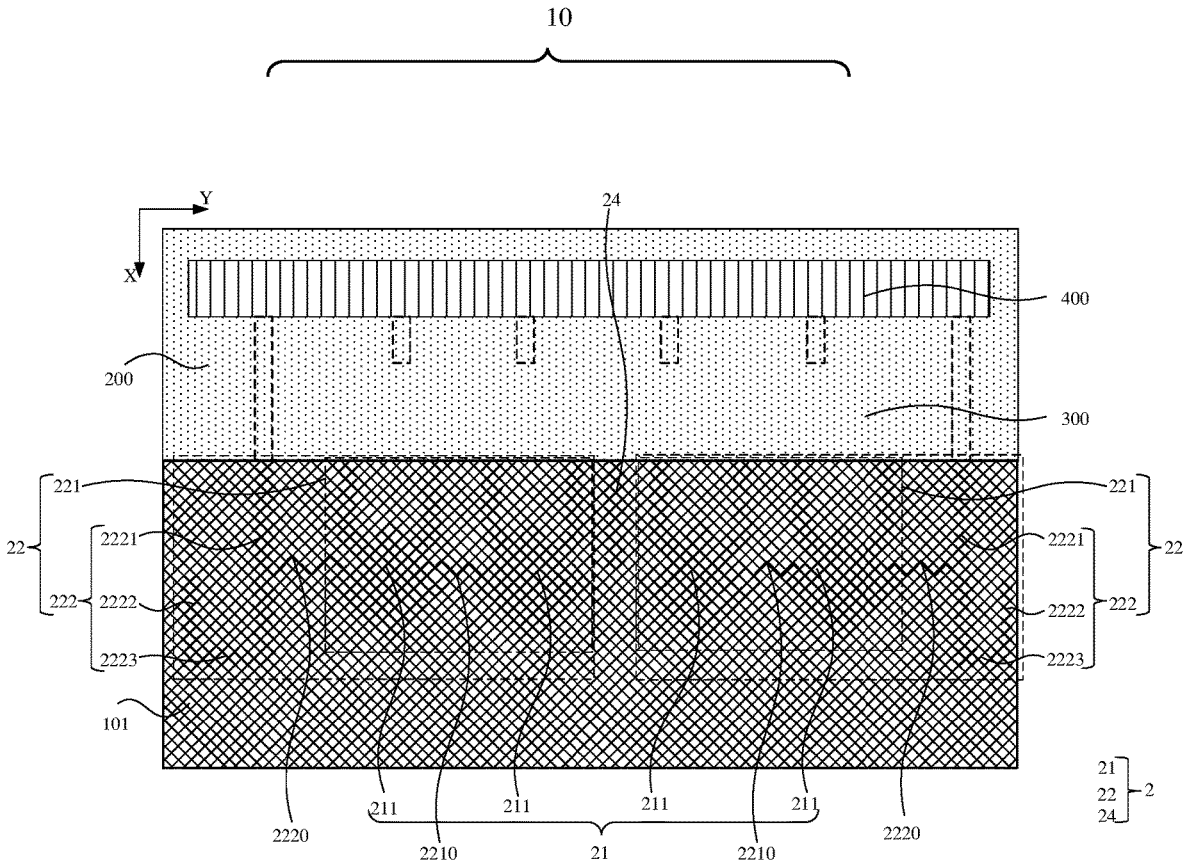
FIG. 24 is a schematic structural diagram of a further display apparatus 10.
Figure 25:
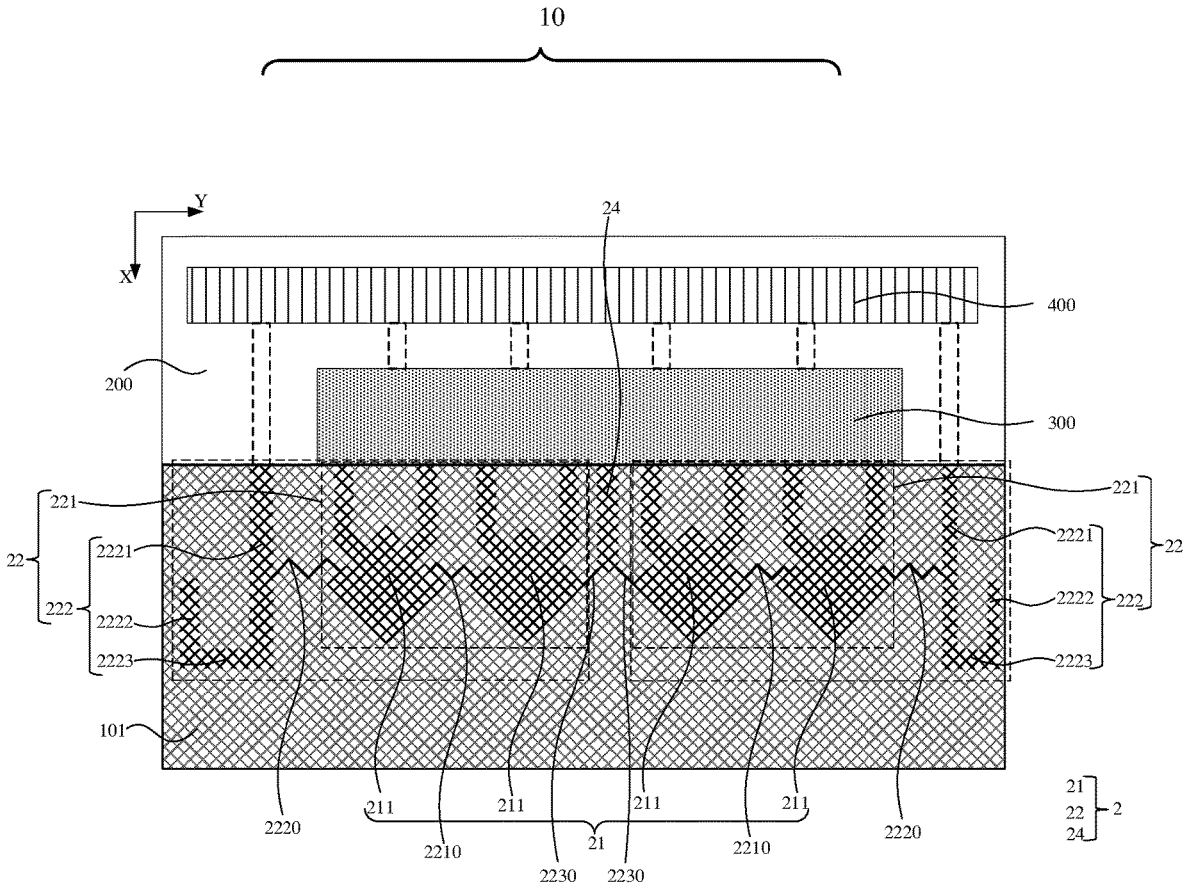
FIG. 25 is a schematic structural diagram of a further display apparatus 10.
Figure 26:
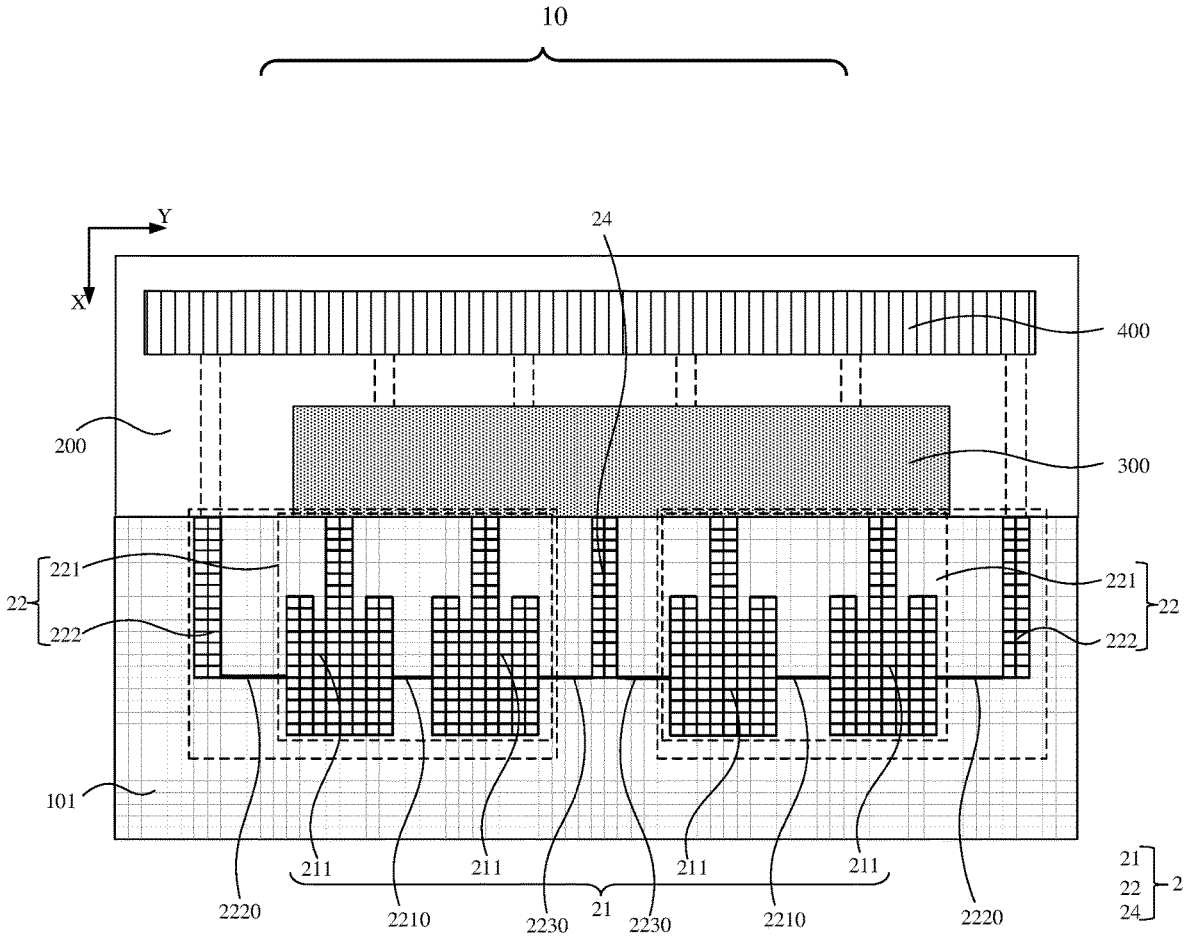
FIG. 26 is a schematic structural diagram of a further display apparatus 10.

It is to be noted that, in some embodiments, referring to FIG. 24 to FIG. 26, the antenna 2 includes at least two non-mm-wave antennas 22. The antenna 2 further includes: an isolation portion 24 located between any two adjacent non-mm-wave antennas 22. In this way, adjacent non-mm-wave antennas 22 may be effectively isolated by the isolation portion 24, so as to reduce a degree of coupling between and a degree of the influence of electronic noise on the adjacent non-mm-wave antennas 22, thereby ensuring better antenna performance and better wireless communication quality of each non-mm-wave antenna 22.

Optionally, as shown in FIG. 24, the isolation portion 24 is configured to be connected to a grounding region in the display apparatus 10. For example, the isolation portion 24 may be connected to a grounding wire or grounding plane in the FPC 200.

Optionally, referring to FIG. 25 and FIG. 26, the isolation portion 24 is connected to the two adjacent non-mm-wave antennas 22. For example, the antenna 2 further includes a third connecting line 2230. The isolation portion 24 is connected to the mm-wave antenna elements 211 closest thereto in the adjacent non-mm-wave antennas 22 through at least one third connecting line 2230. In FIG. 25, the mm-wave antenna elements 211 are dual-polarization mm-wave antenna elements. In FIG. 26, the mm-wave antenna elements 211 are single-polarization mm-wave antenna elements.

Herein, the number, the line length, and the line width of the third connecting line 2230 may be selectively set according to actual requirements, which are not limited in the embodiment of the present disclosure. Optionally, the third connecting line 2230 may be selectively set with reference to the structure of the first connecting line 2210.

Optionally, the isolation portion 24 may be formed by conductive meshes with rectangular contours.

It is to be added that, in another possible implementation, a plurality of mm-wave antenna elements 211 multiplexed to form the first part 221 of the non-mm-wave antenna 22 may also be connected in parallel.

Figure 27:
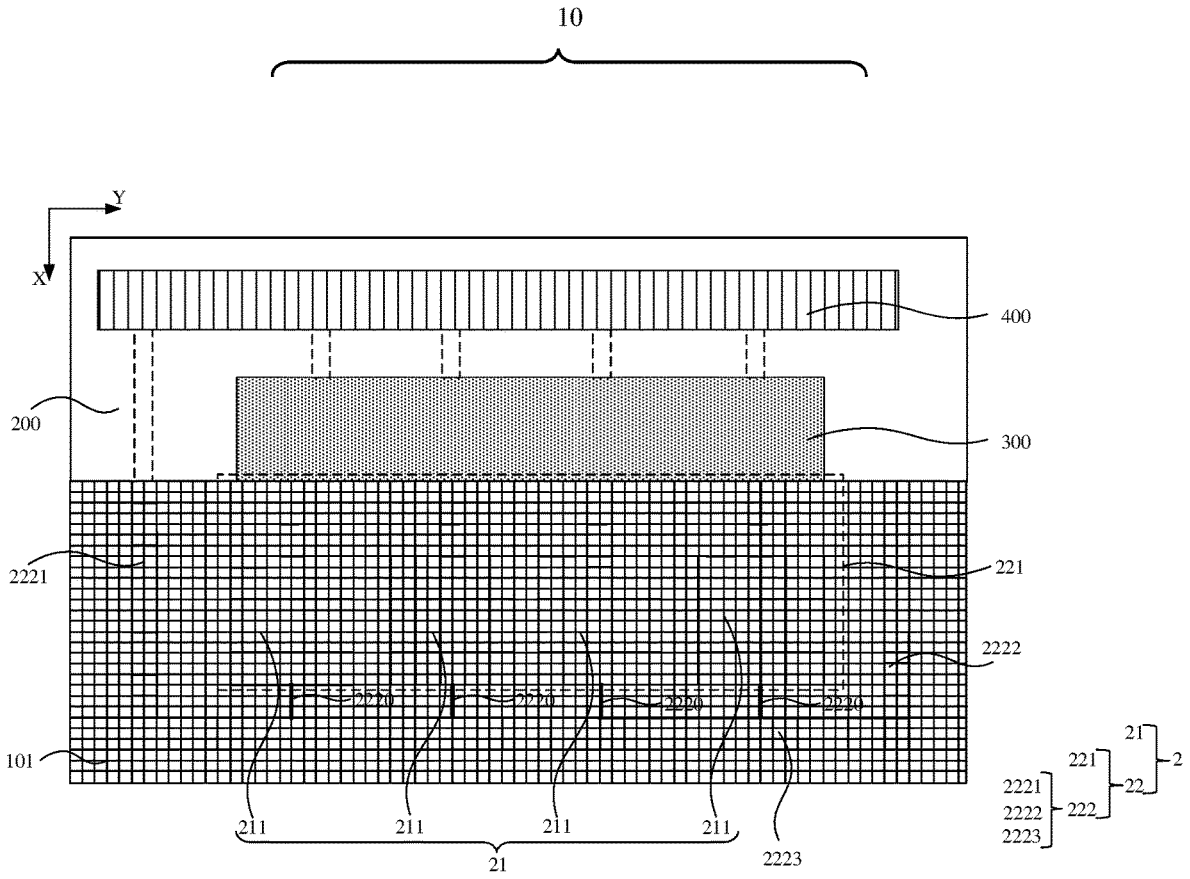
FIG. 27 is a schematic structural diagram of a further display apparatus 10.
Figure 28:
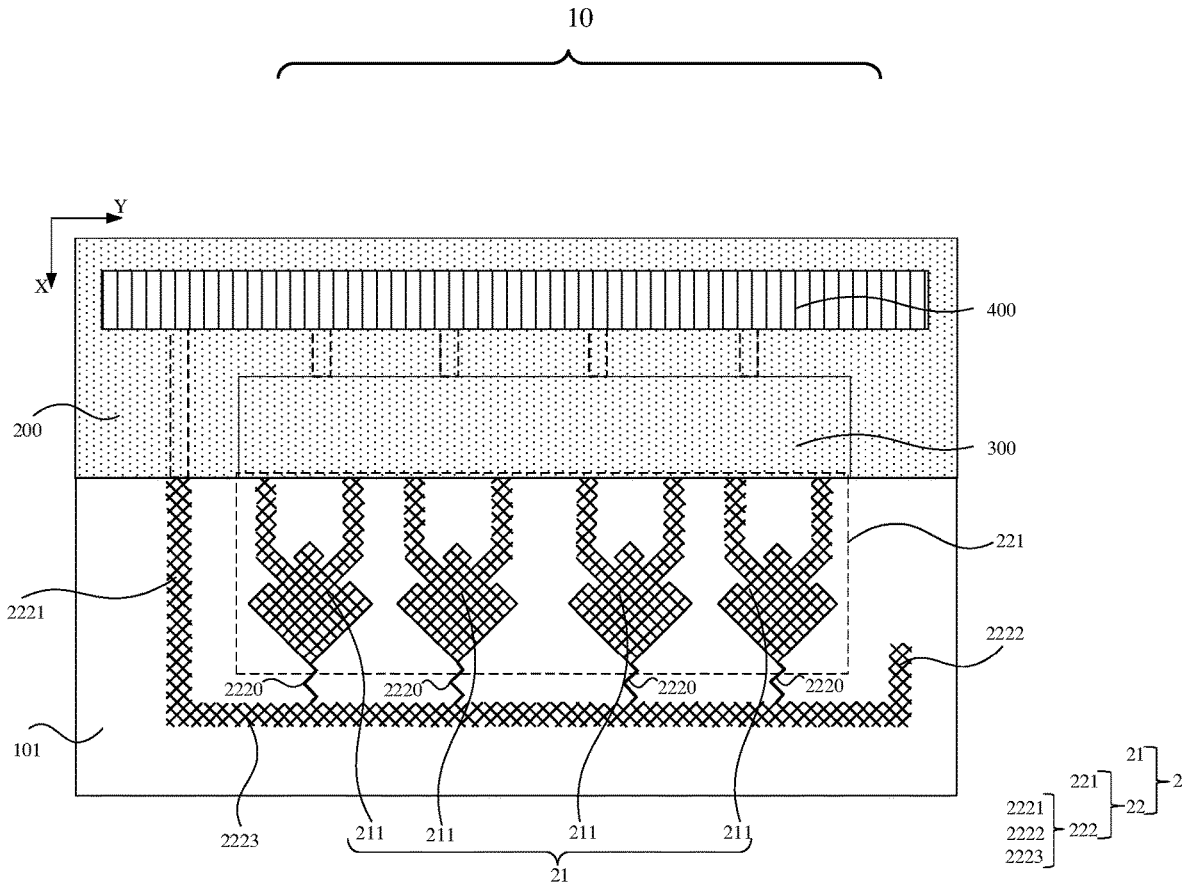
FIG. 28 is a schematic structural diagram of a further display apparatus 10.

For example, referring to FIG. 27 and FIG. 28, the non-mm-wave antenna 22 further includes a second part 222 and a plurality of second connecting lines 2220. Each of the plurality of mm-wave antenna elements 211 multiplexed to form the first part 221 of the non-mm-wave antenna 22 is connected to the second part 222 of the non-mm-wave antenna 22 through at least one second connecting line 2220, for example, connected to the second part 222 of the non-mm-wave antenna 22 through one second connecting line 2220. In this way, the non-mm-wave antenna 22 may have a plurality of different resonant paths to have a plurality of different operating frequency bands, so as to realize multi-band communications of the non-mm-wave antenna 22. For example, the second part 222 of the non-mm-wave antenna 22 is constructed around the corresponding mm-wave antenna 21. In FIG. 25, the mm-wave antenna elements 211 are single-polarization mm-wave antenna elements. In FIG. 26, the mm-wave antenna elements 211 are dual-polarization mm-wave antenna elements. Dual polarization may enhance transmitting and receiving capability (such as achieving multiple-input and multiple-output (MIMO), that is, realize an MIMO operation; or reduce a wireless communication disconnection rate and wireless communication dead zones) of wireless communication signals to improve the wireless communication quality and user wireless experience.

In addition, it is to be noted that, in the implementation, the related settings of the grounding portion 23, the extension portion 2211 and the isolation portion 24 mentioned in some embodiments above may also match the antenna 2 applicable to the implementation, which is not described in detail herein.

Based on the above, in the embodiment of the present disclosure, on the basis of multiplexing the mm-wave antenna elements 211 to form the first part 221 of the non-mm-wave antenna(s) 22, the operating frequency (or frequencies) and bandwidth(s) of the non-mm-wave antenna(s) 22 may be reasonably controlled by setting contour shapes and plane areas of components of the antenna 2, such as the second part 222 of the non-mm-wave antenna 22, the extension portion 2211 in the first part 221 of the non-mm-wave antenna 22, and the grounding portion 23. For example, the operating frequency bands of the non-mm-wave antenna(s) 22 is enabled to cover low-frequency bands, mid-frequency bands, or high-frequency bands, and the bandwidth(s) of the non-mm-wave antenna(s) 22 is enabled to be wider. Thus, the non-mm-wave antenna 22 is ensured to have antenna performance that may meet requirements of use, so as to improve product competitiveness and user wireless experience.

Figure 29:
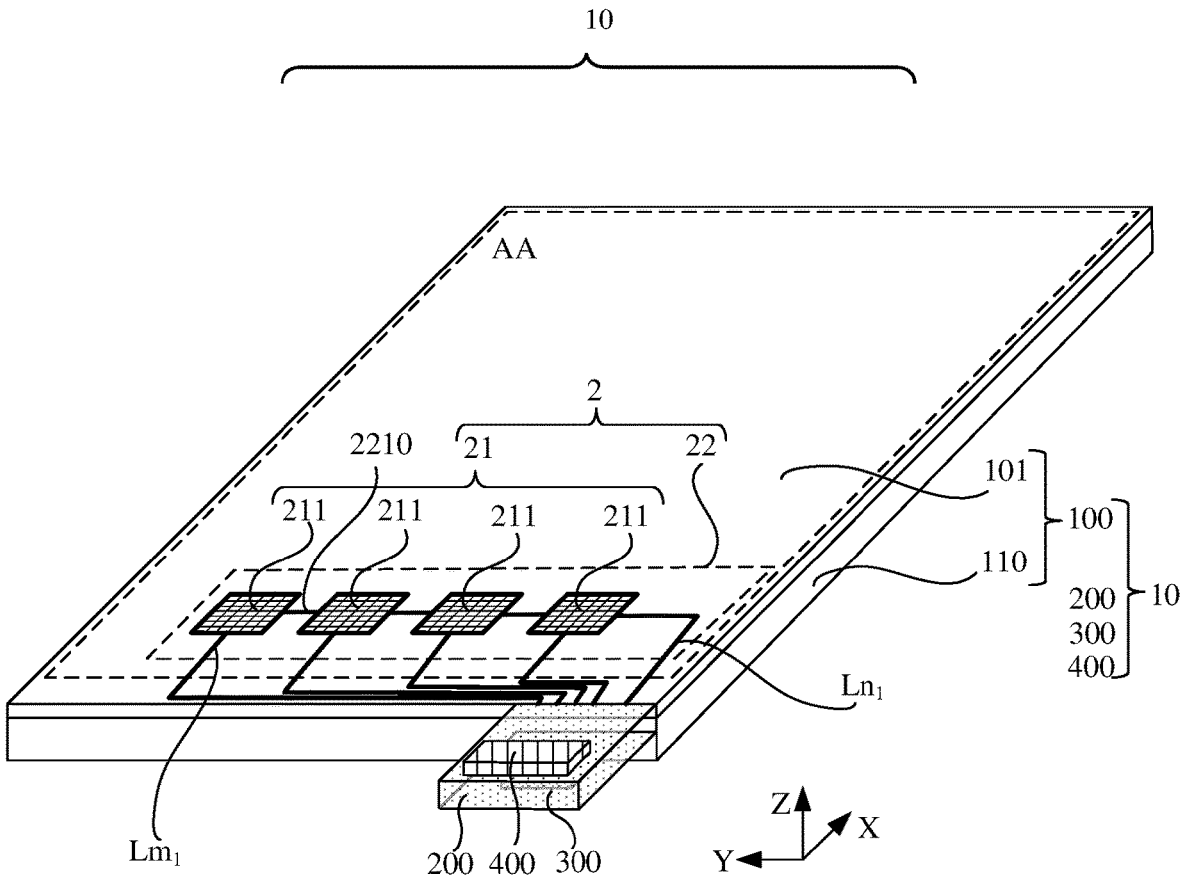
FIG. 29 is a schematic structural diagram of a further display apparatus 10.

An embodiment of the present disclosure further provides a display apparatus 10. Referring to FIG. 29, the display apparatus 10 includes: the display screen 100 integrated with an antenna 2 as described in some embodiments above. The structure of the antenna 2 is as described in some embodiments above. The display screen 100 includes a display panel 110. The antenna 2 may be integrated to the display panel 110 or on the display panel 110.

In some embodiments, as shown in FIG. 29, the display screen 100 includes a conductive mesh layer 101. The conductive mesh layer 101 is arranged on a display side of the display panel 110. The display side of the display panel 110 refers to a light-emitting side of the display panel 110, that is, a side of the display panel 110 that configured to display images.

Optionally, the display panel 110 may be a flexible display panel, for example, an Organic Light-Emitting Diode (OLED) display panel, a Quantum Dot Light Emitting Diodes (QLED) display panel or a Light-Emitting Diode (LED) display panel, but is not limited thereto. For example, the display panel 110 may also be a liquid crystal display panel or the like.

Optionally, the conductive mesh layer 101 may be patterned by conductive materials. The conductive mesh layer 101 is, for example, a metal mesh layer or a transparent conductive material mesh layer. The metal mesh layer may be formed from metals with good electrical properties, such as copper, silver, gold, nickel, or titanium, or alloys thereof. The transparent conductive material mesh layer may be formed by transparent conductive material with high visible light transmittance and strong conductive capability, for example, indium tin oxide (ITO), zinc oxide (ZnO), tin cadmium oxide (CTO), indium oxide (InO), indium (In) doped zinc oxide (ZnO), aluminum (Al) doped zinc oxide (ZnO), or gallium (Ga) doped zinc oxide (ZnO), etc.

Optionally, a thickness of the conductive mesh layer 101 may be selectively set according to actual requirements. The thickness of the conductive mesh layer 101 may range from 100 nm to 1 μm, for example, 100 nm, 200 nm, 500 nm, 800 nm or 1 μm.

Figure 30:
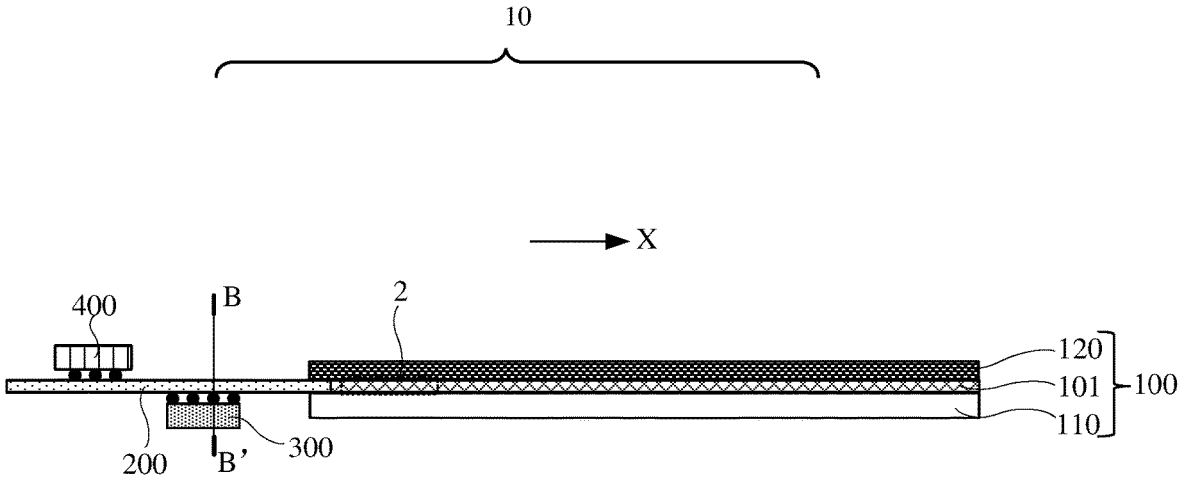
FIG. 30 is a schematic structural diagram of a further display apparatus 10.
Figure 30:
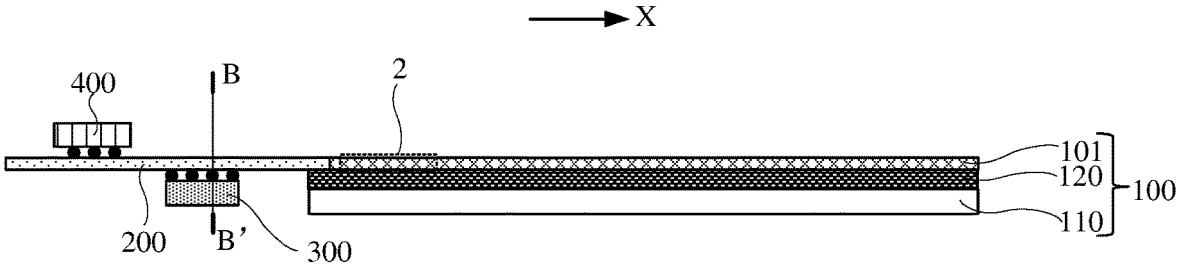

Optionally, the conductive mesh layer 101 is arranged on a display side of the display panel 110. Specifically, in an implementation, the conductive mesh layer 101 is directly arranged on a surface of the display panel 110, or arranged on other structures on the display side of the display panel 110 in the display screen 100. For example, referring to FIG. 30, the display screen 100 further includes a cover plate 120 arranged on the display side of the display panel 110, and the conductive mesh layer 101 is arranged on a side surface of the cover plate 120. For example, as shown in figure (a) of FIG. 30, the conductive mesh layer 101 is arranged on a surface of the cover plate 120 near the display panel 110. Alternatively, in another example, as shown in figure (b) of FIG. 30, the conductive mesh layer 101 is arranged on a surface of the cover plate 120 away from the display panel 110.

In addition, optionally, the conductive mesh layer 101 may be manufactured on the display side of the display panel 110, or manufactured independently and then attached to the display side of the display panel 110. The manufacturing process of the conductive mesh layer 101 is not limited in the embodiment of the present disclosure.

The specific position of the conductive mesh layer 101 in the display screen 100 may be selectively set according to actual requirements, provided that an orthographic projection of the conductive mesh layer 101 on the display panel 110 covers at least a display region of the display panel 110. In this way, an orthographic projection of the antenna 2 formed by at least part of a pattern of the conductive mesh layer 101 on the display panel 110 may be located in a display region AA. The antenna 2 in the display screen 100 may be less easily blocked in use (for example, when it is held in hand or it is placed on a metal table), and is absent from significant deterioration of the performance of the antenna 2 and the influence on wireless experience of users. That is, the communication performance of the antenna 2 can be ensured.

Figure 31:
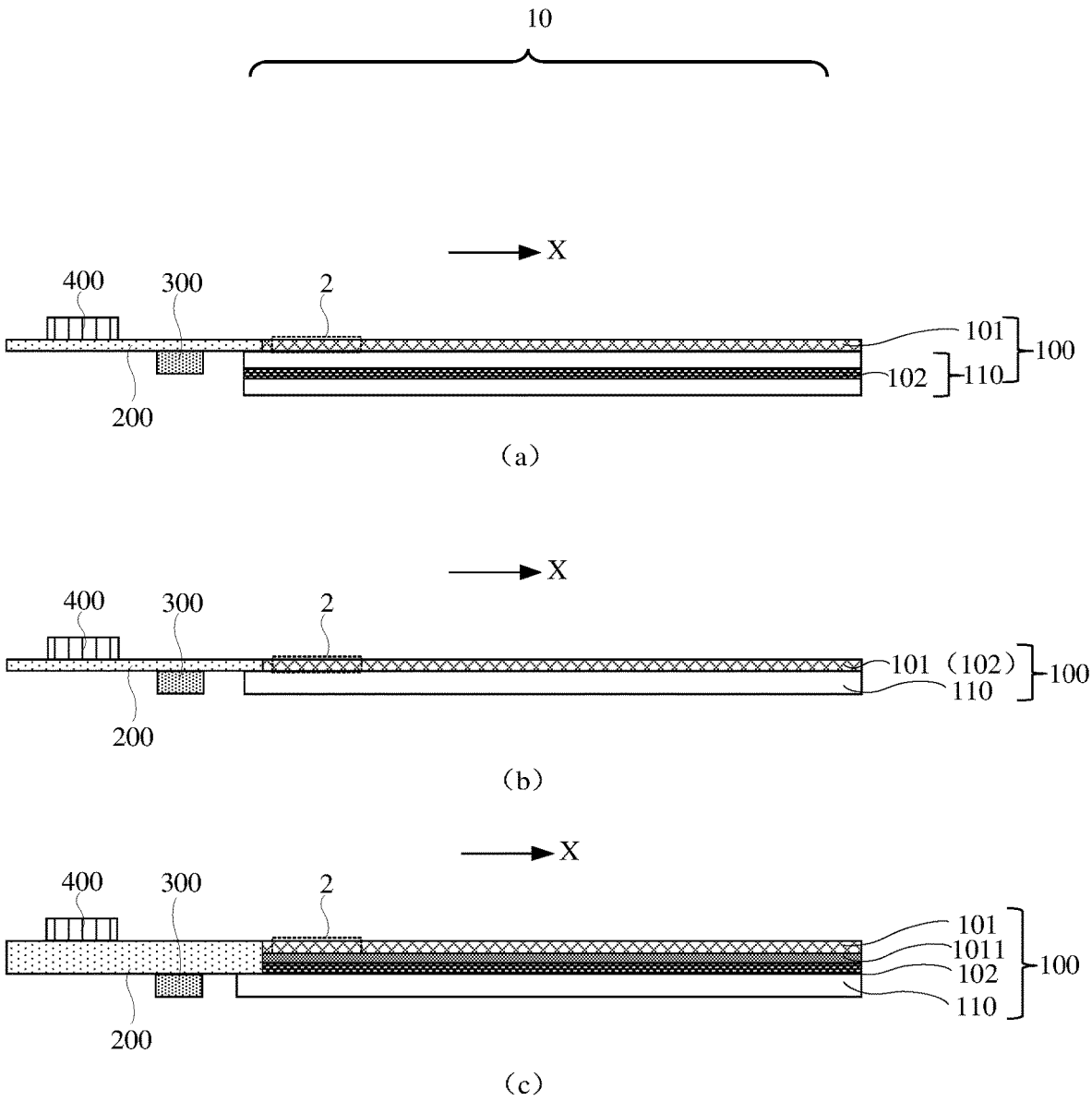
FIG. 31 is a schematic structural diagram of a further display apparatus 10.

Optionally, referring to FIG. 31, the display screen 100 is a touch screen, and the display screen 100 includes a touch layer 102. The touch layer 102 is configured to perform a touch operation, and may be formed by, for example, a touch electrode and a metal bridge wire by staggered connection. The specific structure of the touch layer 102 is not limited in the embodiment of the present disclosure. For example, the touch layer 102 may be arranged on a surface of the display side of the display panel 110 or integrated into the display panel 110. In one implementation, as shown in figure (a) of FIG. 31, the conductive mesh layer 101 is arranged on the display side of the display panel 110, and the touch layer 102 is integrated into the display panel 110. In another implementation, as shown in figure (b) of FIG. 31, the conductive mesh layer 101 is arranged on the display side of the display panel 110, and the conductive mesh layer 101 may be configured as the touch layer 102. That is, the touch layer 102 is arranged on the display side of the display panel 110, and the conductive mesh layer 101 and the touch layer 102 are a same layer. In still another implementation, as shown in figure (c) of FIG. 31, the conductive mesh layer 101 is independent of the touch layer 102, and both the conductive mesh layer 101 and the touch layer 102 are arranged on the display side of the display panel 110. For example, the conductive mesh layer 101 is arranged on one side of the touch layer 102 departing from the display panel 110 and is insulated from the touch layer 102, or the conductive mesh layer 101 is arranged between the touch layer 102 and the display panel 110 and is insulated from the touch layer 102.

In one example, referring to figure (c) of FIG. 31, the conductive mesh layer 101 is arranged on one side of the touch layer 102 departing from the display panel 110, that is, above the touch layer 102. An insulating layer 1011 is arranged between the conductive mesh layer 101 and the touch layer 102, so as to ensure that electrical properties of the conductive mesh layer 101 and the touch layer 102 do not affect each other.

In one example, referring to figure (b) of FIG. 31, the conductive mesh layer 101 is configured as the touch layer 102. The antenna 2 may be formed by a partial pattern in the touch layer 102 located in a touch dead zone. That is, at least part of a pattern of the touch layer 102 located in the touch dead zone may be cut and used as the antenna 2. Herein, the touch dead zone refers to a region without a touch function. In this way, it is beneficial to reduce the number of cutting regions of the conductive mesh and to reduce differences between mesh patterns of different regions in the touch layer 102, to ensure a visual optical effect and a touch effect of a touch screen.

Figure 32:
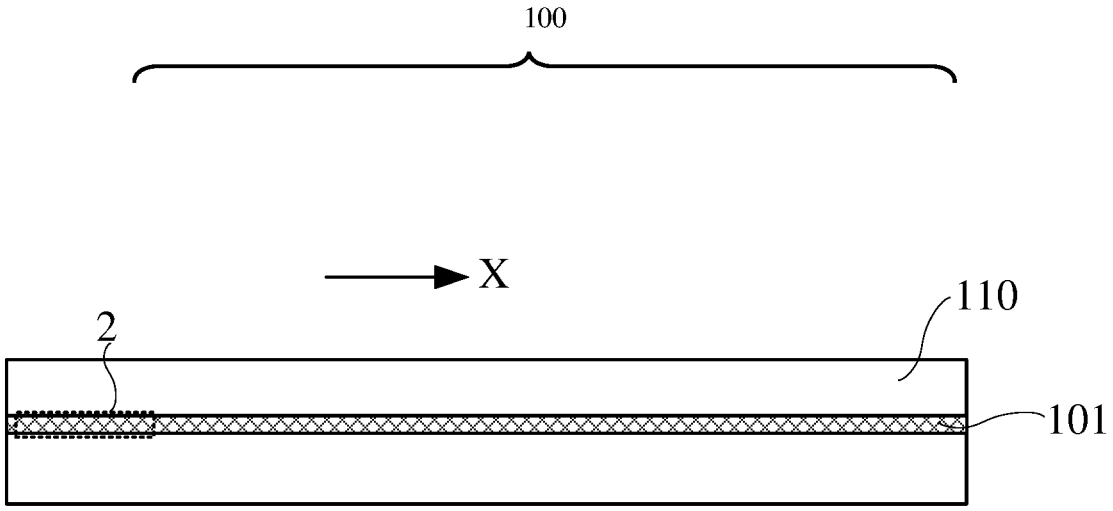
FIG. 32 is a schematic structural diagram of a display screen 100.

In some other embodiments, as shown in FIG. 32, the display screen 100 includes a conductive mesh layer 101. The conductive mesh layer 101 is integrated to the display panel 110. It may be understood that the display panel 110 is generally provided with at least one conductive layer. The conductive layer is, for example, a metal conductive layer or a transparent conductive layer. The conductive layer is, for example, an array metal layer, a wiring layer, an electrode layer (cathode, anode), etc. Exemplarily, the conductive layer is, for example, a transparent, solid conductive sheet structure. The antenna 2 may be formed by using a partial pattern (such as a mesh pattern) of any conductive layer in the display panel 110 to achieve the integration of the antenna 2 in the display panel 110.

In order to describe the embodiment of the present disclosure more clearly, the structure of the display apparatus 10 is described in detail below with an example in which the antenna 2 is arranged on a display side of the display panel 110.

Figure 33:
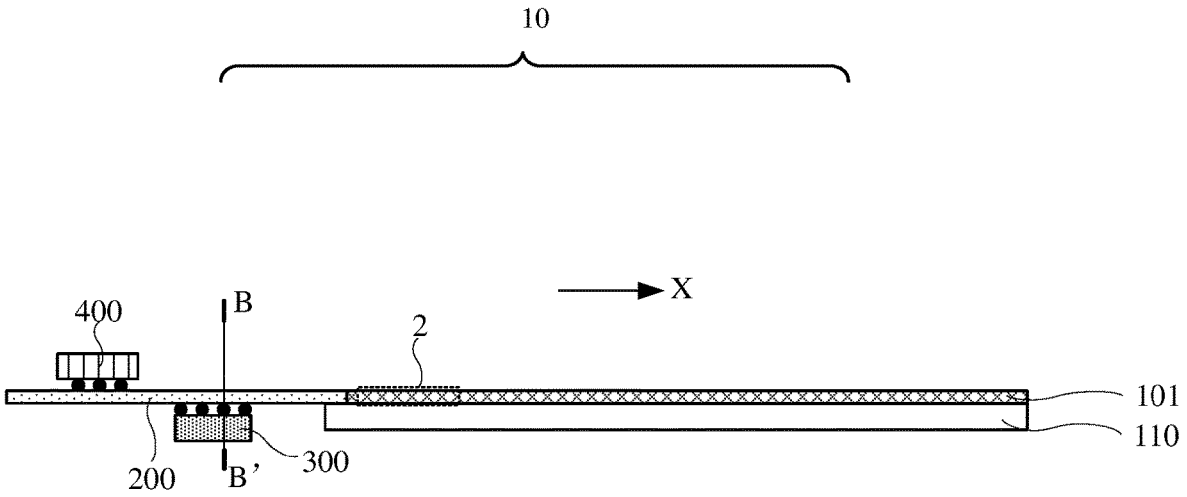
FIG. 33 is a schematic structural diagram of a further display apparatus 10.

Referring to FIG. 33, in some embodiments, the display apparatus 10 further includes an FPC 200. The FPC 200 may be electrically bonded to the display panel 110, to realize a connection between the signal line(s) in the display panel 110 and an external (such as in an electronic device 1) PCB 20. The PCB 20 may be mounted in a housing of the electronic device 1. In addition, the FPC 200 may also be electrically bonded to the antenna 2, to realize a connection of the antenna 2 with a mm-wave RFIC 300 and a non-mm-wave RFIC 500.

It may be understood that the antenna 2 is integrated to the display screen 100 of the display apparatus 10, and the antenna 2 includes a mm-wave antenna 21 and a non-mm-wave antenna 22. Correspondingly, the display apparatus 10 further includes: a mm-wave RFIC 300 configured to be connected to the mm-wave antenna elements 211 in the mm-wave antenna 21, and a non-mm-wave RFIC 500 configured to be connected to the non-mm-wave antenna(s) 22. The mm-wave RFIC 300 and the non-mm-wave RFIC 500 may be both electrically bonded to the FPC 200 or one is electrically bonded to the FPC 200 and the other is electrically bonded to the external PCB 20.

In one implementation, still referring to FIG. 33, the display apparatus 10 further includes a mm-wave RFIC 300 and a connecting base 400 respectively bonded to the FPC 200. The mm-wave RFIC 300 may be correspondingly connected to the mm-wave antenna elements 211 through the circuit(s) in the FPC 200. The connecting base 400 may be correspondingly connected to the non-mm-wave antenna(s) 22 through the circuit(s) in the FPC 200. The connecting base 400 may also be directly connected to the mm-wave RFIC 300 through the via(s) in the FPC 200, or connected to the mm-wave RFIC 300 through the circuit(s) in the FPC 200.

Moreover, the connecting base 400 is configured to connect the external PCB 20, which may serve as a connection hub between the FPC 200 and the PCB 20. In this way, the connecting base 400 may be configured to realize a connection between the mm-wave RFIC 300 and the PCB 20. In addition, the non-mm-wave RFIC 500 may be arranged in the PCB 20, and the connecting base 400 may also be configured to realize a connection between the non-mm-wave antenna(s) 22 and the non-mm-wave RFIC 500.

Figure 34:
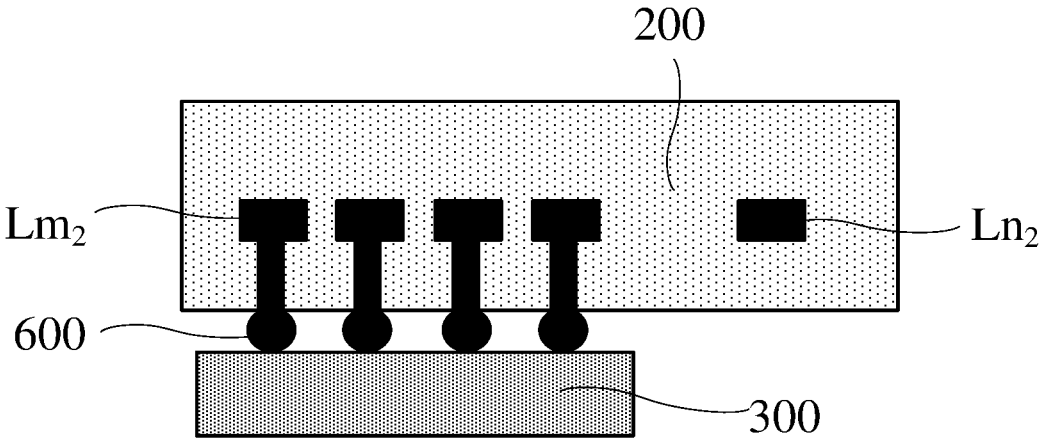
FIG. 34 is a schematic cross-sectional view of an FPC 200 in the display apparatus 10 shown in FIG. 33 taken along B-B'.

Referring to FIG. 29, FIG. 33 and FIG. 34, in some examples, the antenna 2 is located in a display region AA of the display screen 100, but is not limited thereto. For example, the antenna 2 may also be arranged in a peripheral region of the display screen 100. Moreover, the mm-wave antenna elements 211 in the mm-wave antenna 21 may be led out to the peripheral region through their mm-wave feeding portions (such as the mm-wave signal line $Lm_1$), and electrically bonded to the FPC 200. The non-mm-wave antenna(s) 22 may be led out to the peripheral region through its non-mm-wave feeding portion (such as the non-mm-wave signal line $Ln_1$), and electrically bonded to the FPC 200.

Herein, the peripheral region refers to a region of the display screen 10 located on a periphery of the display region AA. The mm-wave signal line $Lm_1$ and the non-mm-wave signal line $Ln_1$ may be the single wire or mesh lines (i.e., formed by the partial mesh pattern(s) of the conductive mesh layer 101).

Referring to FIG. 33 and FIG. 34, FIG. 34 is a schematic cross-sectional view of an FPC in the display apparatus shown in FIG. 33 taken along B-B'. Optionally, the FPC 20 is provided with a mm-wave transmission line(s) $Lm_2$ correspondingly connected to the mm-wave signal line(s) $Lm_1$ and a non-mm-wave transmission line(s) $Ln_2$ correspondingly connected to the non-mm-wave signal line(s) $Ln_1$. It may be understood that the antenna 2 is formed by the partial pattern(s) of the conductive mesh layer 101. The thickness of the conductive mesh layer 101 may be the same as or different from thicknesses of the mm-wave transmission line(s) $Lm_2$ and the non-mm-wave transmission line(s) $Ln_2$ in the FPC 200. Line widths of parallel lines of the first wires L1 (including the first wires L1) and parallel lines of the second wires L2 (including the second wires L2) in the conductive mesh layer 101 may be the same or different from those of the mm-wave transmission line(s) $Lm_2$ and the non-mm-wave transmission line(s) $Ln_2$ in the FPC 200.

Based on this, the mm-wave RFIC 300 may be bonded to the FPC 200 by Chip On Film (COF), or connected to the corresponding mm-wave transmission line(s) $Lm_2$ in the FPC 200 through a conductor 600. The connecting base 400 may be connected to the corresponding non-mm-wave transmission line(s) $Ln_2$ in the FPC 200 through the conductor 600, and connected to a leading-out circuit in the FPC 200 connected to the mm-wave RFIC 300 through the conductor 600. The conductor 600 is, for example, the solder ball(s) or solder pad(s). In this way, in the embodiment of the present disclosure, the mm-wave antenna 21 may be connected to the mm-wave RFIC 300 through the FPC 200. The mm-wave RFIC 300 may be connected to the connecting base 400 through the FPC 200, and then connected to the PCB 20 through the connecting base 400. The non-mm-wave antenna 22 may be connected to the connecting base 400 through the FPC 200 and then connected to the non-mm-wave RFIC 500 through the connecting base 400.

Figure 35:
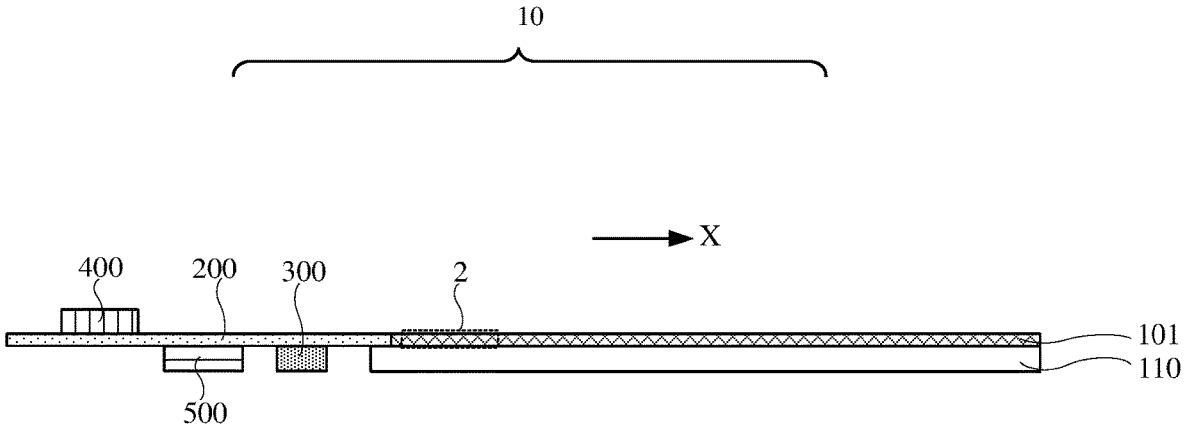
FIG. 35 is a schematic structural diagram of a further display apparatus 10.

In another implementation, referring to FIG. 35, the display apparatus 10 further includes a mm-wave RFIC 300 and a non-mm-wave RFIC 500 respectively arranged on the FPC 200. The mm-wave RFIC 300 is correspondingly connected to the mm-wave antenna element(s) 211 through the circuit(s) in the FPC 200. The non-mm-wave RFIC 500 is correspondingly connected to the non-mm-wave antenna(s) 22 through the circuit(s) in the FPC 200. On this basis, optionally, the display apparatus 10 further includes a connecting base 400 bonded to the FPC 200, and the connecting base 400 is configured to connect the external PCB 20, which may serve as a connection hub between the FPC 200 and the PCB 20. In this way, the connecting base 400 may also be configured to realize connections between the mm-wave RFIC 300 and the PCB 20 and between the non-mm-wave RFIC 500 and the PCB 20.

Based on this, the mm-wave RFIC 300 may be bonded to the FPC 200 by COF, or connected to the corresponding mm-wave transmission line(s) $Lm_2$ in the FPC 200 through the conductor 600. The non-mm-wave RFIC 500 may be bonded to the FPC 200 by COF, or connected to the corresponding non-mm-wave transmission line(s) $Ln_2$ in the FPC 200 through the conductor 600. The connecting base 400 may be connected, through the conductor 600, to the leading-out circuit(s) connected to the mm-wave RFIC 300 and to the leading-out circuit(s) connected to the non-mm-wave RFIC 500 in the FPC 200. The conductor 600 is, for example, the solder ball(s) or solder pad(s). In this way, in the embodiment of the present disclosure, the mm-wave antenna 21 may be connected to the mm-wave RFIC 300 through the FPC 200, and the non-mm-wave antenna 22 may be connected to the non-mm-wave RFIC 500 through the FPC 200. The mm-wave RFIC 300 and the non-mm-wave RFIC 500 may be connected to the connecting base 400 through the FPC 200, and then connected to the PCB 20 through the connecting base 400.

Based on the above, the mm-wave antenna 21 and the non-mm-wave antenna 22 in the antenna 2 can have independent communication links, and the mm-wave antenna 21 and the non-mm-wave antenna 22 can work at the same time without affecting each other.

It is to be noted that the components in the mm-wave RFIC 300 may filter and block non-mm-wave-range energy.

Therefore, the mm-wave RFIC 300 is connected to the non-mm-wave antenna 22 or the first part 221 of the non-mm-wave antenna 22 formed by the mm-wave antenna elements 211 by multiplexing, without affecting the performance of the non-mm-wave antenna 22 and the performance of the mm-wave RFIC 300.

In addition, in an example where the antenna 2 is located in the display region AA of the display screen 100, optionally, the mm-wave antenna elements 211 in the mm-wave antenna 21 may also extend to the peripheral region of the display screen 100, so as to be directly electrically bonded to the FPC 200. The second part in the non-mm-wave antenna 22 may also extend to the peripheral region of the display screen 100, so as to be directly electrically bonded to the FPC 200, which is not limited in the embodiment of the present disclosure.

Optionally, the FPC 200 may also be replaced by other carriers capable of carrying the mm-wave transmission line(s) $Lm_2$ and the non-mm-wave transmission line(s) $Ln_2$.

In the embodiment of the present application, the mm-wave antenna 21 and the non-mm-wave antenna 22 may share a same FPC 200 to reduce a total number of FPCs in the display apparatus 10 and reduce assembly complexity of the display apparatus 10, thereby helping improve the manufacturing efficiency of the display apparatus 10 and reducing manufacturing costs of the display apparatus 10.

An embodiment of the present disclosure further provides an electronic device 1, including the display apparatus 10 in some embodiments above. The structure of the display apparatus 10 may be obtained with reference to the relevant description in some embodiments above, and is not described in detail herein.

Optionally, the electronic device 1 further includes a PCB 20 connected to the display apparatus 10. In addition, optionally, the PCB 20 may also be provided with functional components such as the intermediate frequency components and the baseband platform(s), so as to meet usage requirements of the antenna 2.

Figure 36:
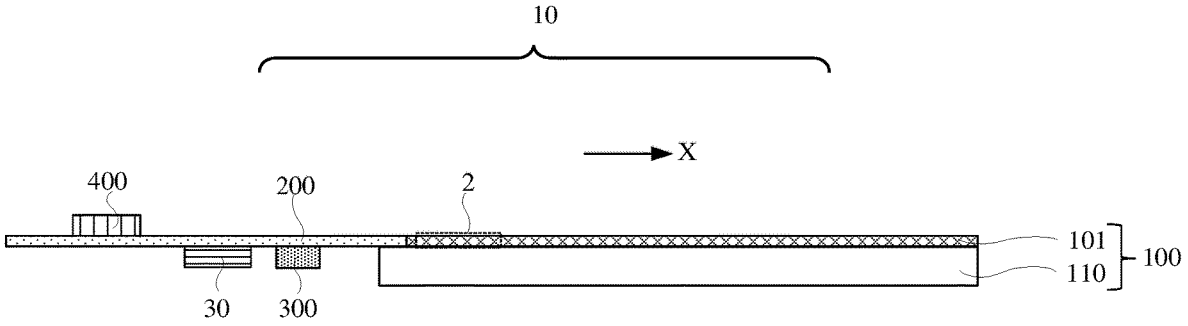
FIG. 36 is a schematic structural diagram of a further display apparatus 10.
Figure 37:
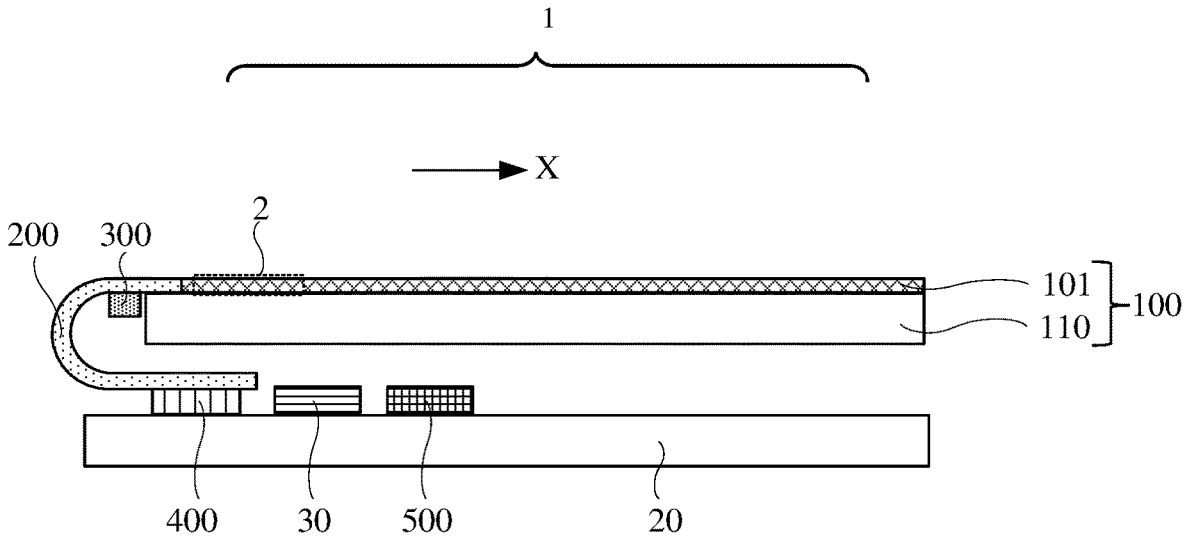
FIG. 37 is a schematic structural diagram of another electronic device 1.

It is to be added that, in some embodiments, referring to FIG. 36 and FIG. 37, the electronic device 1 further includes the non-mm-wave tunable component(s) 30 to tune the non-mm-wave antenna 22.

Optionally, as shown in FIG. 36, the non-mm-wave tunable component(s) 30 is arranged on the FPC 200 of the display apparatus 10, so as to be connected to the non-mm-wave antenna 22 through the FPC 200.

Optionally, as shown in FIG. 37, the non-mm-wave tunable component(s) 30 is arranged on the PCB 20. The connecting base 400 electrically bonded to the FPC 200 is electrically bonded to the PCB 20. In this way, the non-mm-wave tunable component(s) 30 may be connected to the non-mm-wave antenna 22 through the FPC 200.

In addition, the non-mm-wave tunable component(s) 30 may be composed of the electrically tunable component(s), for example, the components such as the variable capacitor(s), variable inductor(s), or the switching components.

Based on the above, with reference to the relevant description of the communication links of the non-mm-wave antenna(s) 22 in some embodiments above, the non-mm-wave tunable component(s) 30 may realize the electrical connection(s) (including series connection(s) or parallel connection(s)) with the non-mm-wave antenna(s) 22, so as to tune the non-mm-wave antenna(s) 22, thereby reconfigure the antenna performance of the non-mm-wave antenna(s) 22.

In the embodiment of the present disclosure, the beneficial effects achieved by the electronic device 1 and the display apparatus 10 are the same as those achieved by the display screen 100 integrated with the antenna 2 according to some embodiments above, which are not described in detail herein.

The electronic device 1 according to some embodiments of the present disclosure may be any apparatus capable of wireless communication for use in the field of display, whether in motion (e.g., video) or stationary (e.g., still image), and whether textual or pictorial. More particularly, it is contemplated that the embodiments may be implemented in a variety of wireless communication display apparatuses.

The electronic device 1 according to some embodiments of the present disclosure includes, but is not limited to, devices with wireless communication and display performance such as mobile telephones, wireless apparatuses, Portable Android Devices (PADs), handheld or portable computers, GPS receivers/navigators, cameras, MPEG-4 Part 14 (MP4) video players, video cameras, TV monitors, flat panel displays, computer monitors and aesthetic structures (e.g., displays for displaying images of a piece of jewelry).

In a case where "comprise", "have", and "include" described herein are used, another member may be added unless an explicitly qualified terms, such as "only" and "formed by . . . ", are used. Unless otherwise mentioned, the terms in singular forms may include plural forms and cannot be understood as being one.

The technical features in the above embodiments may be randomly combined. For concise description, not all possible combinations of the technical features in the above embodiments are described. However, all the combinations of the technical features are to be considered as falling within the scope described in this specification provided that they do not conflict with each other.

The above embodiments only describe several implementations of the present disclosure, and their description is specific and detailed, but cannot therefore be understood as a limitation on the patent scope of the invention. It should be noted that those of ordinary skill in the art may further make variations and improvements without departing from the conception of the present disclosure, and these all fall within the protection scope of the present disclosure. Therefore, the patent protection scope of the present disclosure should be subject to the appended claims.

What is claimed is:

1. An antenna integrated display screen comprising a conductive mesh layer, and the antenna is formed by at least part of a pattern of the conductive mesh layer, wherein the antenna comprises a millimeter-wave (mm-wave) antenna;

wherein the mm-wave antenna comprises a plurality of mm-wave antenna elements, and the mm-wave antenna elements comprises radiation portions;

wherein the radiation portions of at least two of the mm-wave antenna elements are connected to each other through a conductive structure to form a connection structure, the conductive structure is configured to transmit non-mm-wave energy and block mm-wave energy; and the connection structure is multiplexed to form at least a radiation portion of a first part of a non-mm-wave antenna.

2. The display screen according to claim 1, wherein the mm-wave antenna element comprises: a conductive mesh formed by a plurality of first wires extending along a first direction and a plurality of second wires extending along a second direction by crossing.

3. The display screen according to claim 2, wherein the first direction intersects the second direction.

4. The display screen according to claim 2, wherein the conductive mesh layer is configured as a touch layer; and the antenna is formed by at least part of a pattern in the touch layer.

5. The display screen according to claim 2, wherein the connection structure comprises a first connecting line; and the radiation portions of any two adjacent mm-wave antenna elements in the connection structure are connected through at least one first connecting line.

6. The display screen according to claim 5, wherein a line width of the first connecting line is less than or equal to a line width of the first wire or the second wire.

7. The display screen according to claim 5, wherein the radiation portions of any two adjacent mm-wave antenna elements in the connection structure are connected through a plurality of first connecting lines, a sum of line widths of the plurality of first connecting lines is defined as a first size, a side length of a side of the radiation portion of any of the mm-wave antenna elements correspondingly connected to the plurality of first connecting lines is defined as a second size, and the first size is less than or equal to one fourth of the second size.

8. The display screen according to claim 1, wherein the non-mm-wave antenna further comprises a second part, and the second part is adjacent to the mm-wave antenna; and wherein the conductive structure comprises a first connecting line and a second connecting line; the radiation portions of any two adjacent mm-wave antenna elements in the connection structure are connected through at least one first connecting line; and the second part is connected to the radiation portion of any one of the mm-wave antenna elements in the connection structure through the second connecting line;

or, the conductive structure comprises a second connecting line; and the radiation portions of the mm-wave antenna elements in the connection structure are separately arranged and connected to the second part through the second connecting line respectively.

9. The display screen according to claim 8, wherein the second part is located on one side of the mm-wave antenna, or the second part is constructed around the mm-wave antenna.

10. The display screen according to claim 8, wherein the antenna further comprises a grounding portion;

wherein the grounding portion is located on one side of the second part away from the mm-wave antenna and connected to the second part;

or, the grounding portion is located on one side of the mm-wave antenna away from the second part, and connected to the radiation portion of any one of the mm-wave antenna elements in the connection structure through the second connecting line;

or, the grounding portion is located between the mm-wave antenna and the second part, and connected to the radiation portion of any one of the mm-wave antenna elements in the connection structure through the second connecting line;

or, at least two non-mm-wave antennas are provided, and the grounding portion is located between two adjacent non-mm-wave antennas.

11. The display screen according to claim 8, wherein the first part further comprises an extension portion;

wherein the extension portion is located on one side of the mm-wave antenna away from the second part;

or the extension portion is located between the second part and the mm-wave antenna.

12. The display screen according to claim 11, wherein one end of the extension portion is connected to the radiation portion of any one of the mm-wave antenna elements in the connection structure and another end of the extension portion is suspended.

13. The display screen according to claim 11, wherein the extension portion is composed of at least one first connecting line with one end suspended.

14. The display screen according to claim 8, wherein the second part further comprises a first section, a final section and a middle section connected between the first section and the final section; and the first section is configured to be connected to a non-mm-wave radio frequency integrated circuit (non-mm-wave RFIC);

wherein the first section is connected to the radiation portion of any one of the mm-wave antenna elements in the connection structure; or wherein the first section and the final section are located on two sides of the mm-wave antenna respectively, and the final section is connected to the radiation portion of the mm-wave antenna element closest to the final section in the connection structure.

15. The display screen according to claim 8, wherein at least two non-mm-wave antennas are provided; and wherein the second parts in different non-mm-wave antennas have different structures.

16. The display screen according to claim 1, wherein at least two non-mm-wave antennas are provided; and the antenna further comprises an isolation portion located between any two adjacent non-mm-wave antennas.

17. The display screen according to claim 16, wherein the isolation portion is connected to the two adjacent non-mm-wave antennas respectively; the antenna further comprises a third connecting line; and the isolation portion is connected to the radiation portion of the mm-wave antenna element closest to the isolation portion in the adjacent non-mm-wave antennas through the third connecting line.

18. A display apparatus, comprising: the antenna integrated display screen according to claim 1;

wherein the display apparatus further comprising a Flexible Printed Circuit (FPC) and a mm-wave RFIC and a connecting base that are arranged on the FPC; wherein the mm-wave RFIC is connected to the mm-wave antenna elements and the connecting base through the FPC; and the connecting base is connected to the non-mm-wave antenna through the FPC and configured to be connected to a non-mm-wave RFIC; or wherein the display apparatus further comprising an FPC and a mm-wave RFIC and a non-mm-wave RFIC that are arranged on the FPC; wherein the mm-wave RFIC is connected to the mm-wave antenna elements through the FPC; and the non-mm-wave RFIC is connected to the non-mm-wave antenna through the FPC.

19. An electronic device, comprising: the display apparatus according to claim 18;

the electronic device further comprising a non-mm-wave tunable component configured to tune the non-mm-wave antenna;

wherein the non-mm-wave tunable component is arranged on the FPC; or wherein the electronic device further comprising a Printed Circuit Board (PCB) connected to the FPC, the non-mm-wave tunable component being arranged on the PCB.

* * * * *